US011066776B2

(12) United States Patent
Ko et al.

(10) Patent No.: US 11,066,776 B2
(45) Date of Patent: Jul. 20, 2021

(54) WASHING MACHINE

(71) Applicant: SAMSUNG ELECTRONICS CO., LTD., Suwon-si (KR)

(72) Inventors: Gi Hoon Ko, Seoul (KR); Youn Young Gwak, Seoul (KR); Han Na Yoo, Seoul (KR); Kang Kyung Lee, Seoul (KR); Seok Geun Jang, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 113 days.

(21) Appl. No.: 16/487,142

(22) PCT Filed: Dec. 15, 2017

(86) PCT No.: PCT/KR2017/014805
§ 371 (c)(1),
(2) Date: Aug. 20, 2019

(87) PCT Pub. No.: WO2018/151402
PCT Pub. Date: Aug. 23, 2018

(65) Prior Publication Data

US 2020/0232149 A1 Jul. 23, 2020

(30) Foreign Application Priority Data

Feb. 20, 2017 (KR) ..... 10-2017-0022076

(51) Int. Cl.
*D06F 39/02* (2006.01)
*D06F 23/04* (2006.01)
(Continued)

(52) U.S. Cl.
CPC ..... *D06F 39/028* (2013.01); *D06F 23/04* (2013.01); *D06F 37/30* (2013.01); *D06F 39/022* (2013.01); *D06F 39/14* (2013.01)

(58) Field of Classification Search
CPC ..... D06F 39/02; D06F 39/022; D06F 39/14
See application file for complete search history.

(56) References Cited

U.S. PATENT DOCUMENTS

2004/0000177 A1 1/2004 Maeng
2008/0028802 A1 2/2008 Jordan et al.

FOREIGN PATENT DOCUMENTS

CN 110382766 10/2019
EP 3 550 064 10/2019
(Continued)

OTHER PUBLICATIONS

European Office Action dated Jul. 3, 2020 from European Application No. 17896684.2, 4 pages.
(Continued)

*Primary Examiner* — Spencer E Bell
(74) *Attorney, Agent, or Firm* — Staas & Halsey LLP

(57) ABSTRACT

A washing machine capable of automatically supplying detergents to a detergent mixing tub uses a detergent dispenser removably mounted to an upper portion of the washing machine. A washing machine capable of automatically supplying softening agents to a softening agent mixing tub uses a softening agent dispenser removably mounted to an upper portion of the washing machine. A washing machine capable of automatically supplying detergents to a washing tub uses a pump coupled to a detergent dispenser mounted to an upper portion of the washing machine and the pump is operated by using a driving force of a motor coupled to a door. A washing machine capable of automatically supplying softening agents to a washing tub uses a pump coupled to a softening agent dispenser mounted to an upper portion of the washing machine and operated by using a driving force of a motor coupled to a door.

11 Claims, 14 Drawing Sheets

(51) Int. Cl.
*D06F 37/30* (2020.01)
*D06F 39/14* (2006.01)

(56) References Cited

FOREIGN PATENT DOCUMENTS

| | | | |
|---|---|---|---|
| KR | 0123413 | B1 | 11/1997 |
| KR | 1998-024353 | U | 7/1998 |
| KR | 10-1490168 | B1 | 2/2015 |
| KR | 10-1614165 | B1 | 4/2016 |

OTHER PUBLICATIONS

Extended European Search Report dated Dec. 9, 2019 from European Application No. 17896684.2, 6 pages.
International Search Report dated Apr. 9, 2018 in International Patent Application No. PCT/KR2017/014805, 5 pages.
Written Opinion of the International Searching Authority dated Apr. 9, 2018 in International Patent Application No. PCT/KR2017/014805, 6 pages.
Chinese Office Action dated Mar. 26, 2021 from Chinese Application No. 201780088645.7.

WASHING MACHINE

CROSS-REFERENCE TO RELATED APPLICATIONS

This application is a U.S. National Stage Application which claims the benefit under 35 U.S.C. § 371 of International Patent Application No. PCT/KR2017/014805 filed on Dec. 15, 2017, which claims foreign priority benefit under 35 U.S.C. § 119 of Korean Patent Application No. 10-2017-0022076 filed on Feb. 20, 2017 in the Korean Intellectual Property Office, the contents of both of which are incorporated herein by reference.

TECHNICAL FIELD

The present disclosure relates to a washing machine. Particularly, a washing machine capable automatically supplying detergents to a washing tub by using a removable detergent dispenser.

BACKGROUND ART

Generally, a washing machine refers to an electronic device that can wash laundry including clothes, bedding or towels, or other textile products using a detergent or a cleaner. The washing machine includes a washing tub in which laundry and washing water is received and the washing machine performs washing by the rotation of the washing tub by a motor and the relative movement of the laundry.

The washing machine may be classified into a front loading type washing machine that performs washing using a relative movement between laundry and an inner circumferential surface of a washing tub by rotating the washing tub, which is arranged in parallel with (or tilted) with respect to the bottom surface, clockwise or counterclockwise with respect to a rotation axis, and a top loading type washing machine that performs washing using a water current generated by a pulsator when a washing tub, which is arranged perpendicular to the bottom surface and provided with the pulsator, is rotated clockwise or counterclockwise with respect to a rotation axis.

The washing machine may be provided with a detergent supply unit (or a softening agent supply unit) configured to supply mixed water, in which washing water and detergents (or softening agents) are mixed, to the washing tub.

DISCLOSURE

Technical Problem

The present disclosure is directed to providing a washing machine capable of automatically or manually supplying a detergent by an easily removable detergent dispenser.

Technical Solution

One aspect of the present disclosure provides a detergent supply unit including a detergent dispenser mounted to an accommodation portion in an upper portion of a body and configured to accommodate detergents, a detergent mixing tub configured to mix some of the detergent with washing water, a pump coupled to the detergent dispenser and configured to supply some of the detergent from the detergent dispenser to the detergent mixing tub, and a driver coupled to a door and configured to transmit a driving force driving the pump, and the pump includes a pump handle configured to perform a reciprocating motion by the driving force, and a detergent discharge port configured to discharge some of the detergent is provided at one end of the pump handle.

The pump may further include a detergent suction pipe of the pump configured to suck some of the detergent from the inside of the detergent dispenser.

The pump handle may be connected to the detergent suction pipe and the pump handle may be located outside the detergent dispenser.

The pump handle may be rotatable about the detergent dispenser.

The pump may receive the driving force from a motor of the driver located above the pump.

The driver may include a motor configured to transmit the driving force to a belt, the belt configured to receive the driving force from a pulley coupled to a drive shaft of the motor, and a rotary cam configured to receive the driving force from the belt, and the rotary cam may convert the transmitted driving force to a reciprocating motion.

A bottom surface of a rotary cam bottom of the rotary cam may be exposed in a direction of the pump handle.

The detergent mixing tub may receive washing water from a water supply unit.

Detergent mixed water that is mixed in the detergent mixing tub may be discharged through a mixed water hose connected to a lower portion of the detergent mixing tub.

The detergent mixed water discharged through the mixed water hose may be discharged to a washing tub via a detergent container.

The detergent supply unit may further include a plurality of accommodation portion grooves provided on opposite sides of the accommodation portion, and through the plurality of accommodation portion grooves, a plurality of grooves provided on opposite sides of the detergent dispenser may be exposed to be gripped.

Another aspect of the present disclosure provides a washing machine including a body including an opening provided in an upper portion of the body, a door configured to open and close the opening of the body, a washing tub installed inside the body, a detergent dispenser configured to store detergents, an accommodating portion located in the upper portion of the body and configured to accommodate the detergent dispenser, a detergent mixing tub provided on one side of the accommodating portion, a first pump coupled to the detergent dispenser and configured to supply some of the detergent stored in the detergent dispenser to the detergent mixing tub, and a first driver coupled to the door and configured to transmit a driving force driving the first pump, and the pump includes a pump handle configured to perform a reciprocating motion by the driving force, and a detergent discharge port configured to discharge some of the detergent is provided at one end of the pump handle.

A rotary cam of the driver may transmit the driving force by being in contact with the pump handle.

The washing machine may further include a water supply unit configured to supply water to the detergent mixing tub and a mixed water hose configured to provide a flow path in which some of the detergent and the water, which are supplied to the detergent mixing tub, is supplied to the washing tub.

A distance between the first driver and the first pump may vary according to the open and close of the door.

The washing machine may further include a softening agent dispenser configured to store softening agents, an accommodating portion located in the upper portion of the body and configured to accommodate the softening agent dispenser, a softening agent mixing tub provided on one side of the accommodating portion, a second pump coupled to the softening agent dispenser and configured to supply some of the softening agent stored in the softening agent dispenser to the softening agent mixing tub, and a second driver coupled to the door and configured to transmit a driving force driving the second pump.

The detergent dispenser and the softening agent dispenser may be arranged on opposite sides of the washing tub.

A capacity of the detergent dispenser may be different from a capacity of the softening agent dispenser.

A distance between the second driver and the second pump may vary according to the open and close of the door.

Another aspect of the present disclosure provides a washing machine including a detergent dispenser mounted to an accommodation portion located in an upper portion of a body and configured to accommodate detergents, a detergent mixing tub configured to mix some of the detergent with washing water so as to make detergent mixed water and including a mixed water hose configured to directly discharge the detergent mixed water to a washing tub, a pump coupled to the detergent dispenser and configured to supply some of the detergent from the detergent dispenser to the detergent mixing tub, and a driver coupled to a door and configured to transmit a driving force driving the pump, and the pump includes a pump handle configured to perform a reciprocating motion by the driving force, and a detergent discharge port configured to discharge some of the detergent is provided at one end of the pump handle.

Advantageous Effects

It is possible to provide a washing machine having a detergent dispenser configured to be easily removable from an upper portion of the washing machine.

It is possible to provide a washing machine having a softening agent dispenser configured to be easily removable from an upper portion of the washing machine.

It is possible to provide a washing machine capable of allowing a user to intuitively check an amount of detergent in a detergent dispenser installed in an upper portion of the washing machine.

It is possible to provide a washing machine capable of allowing a user to intuitively check an amount of softening agent in a softening agent dispenser installed in an upper portion of the washing machine.

It is possible to provide a washing machine having a short distance between a detergent dispenser installed in an upper portion of the washing machine and a detergent mixing tub in which a detergent is mixed with washing water.

It is possible to provide a washing machine having a short distance between a softening agent dispenser installed in an upper portion of the washing machine and a softening agent mixing tub in which a softening agent is mixed with washing water.

It is possible to provide a washing machine capable of directly discharging detergent mixed water from a detergent mixing tub to a washing tub.

It is possible to provide a washing machine capable of directly discharging softening agent mixed water from a softening agent mixing tub to a washing tub.

It is possible to provide a washing machine capable of supplying a detergent from a detergent pump, which is located inside of a detergent dispenser mounted to an upper portion of the washing machine, to a detergent mixing tub by using a driving force transmitted from a motor coupled to a door.

It is possible to provide a washing machine capable of supplying a softening agent from a softening agent pump, which is located inside of a softening agent dispenser mounted to an upper portion of the washing machine, to a softening agent mixing tub by using a driving force transmitted from a motor coupled to a door.

Advantages affect is not limited thereto, and thus it is possible to provide a washing machine capable of automatically (or manually) supplying a detergent (or a softening agent) through an easily removable detergent dispenser (or an easily removable softening agent dispenser).

MODES OF THE INVENTION

Figure 1A:
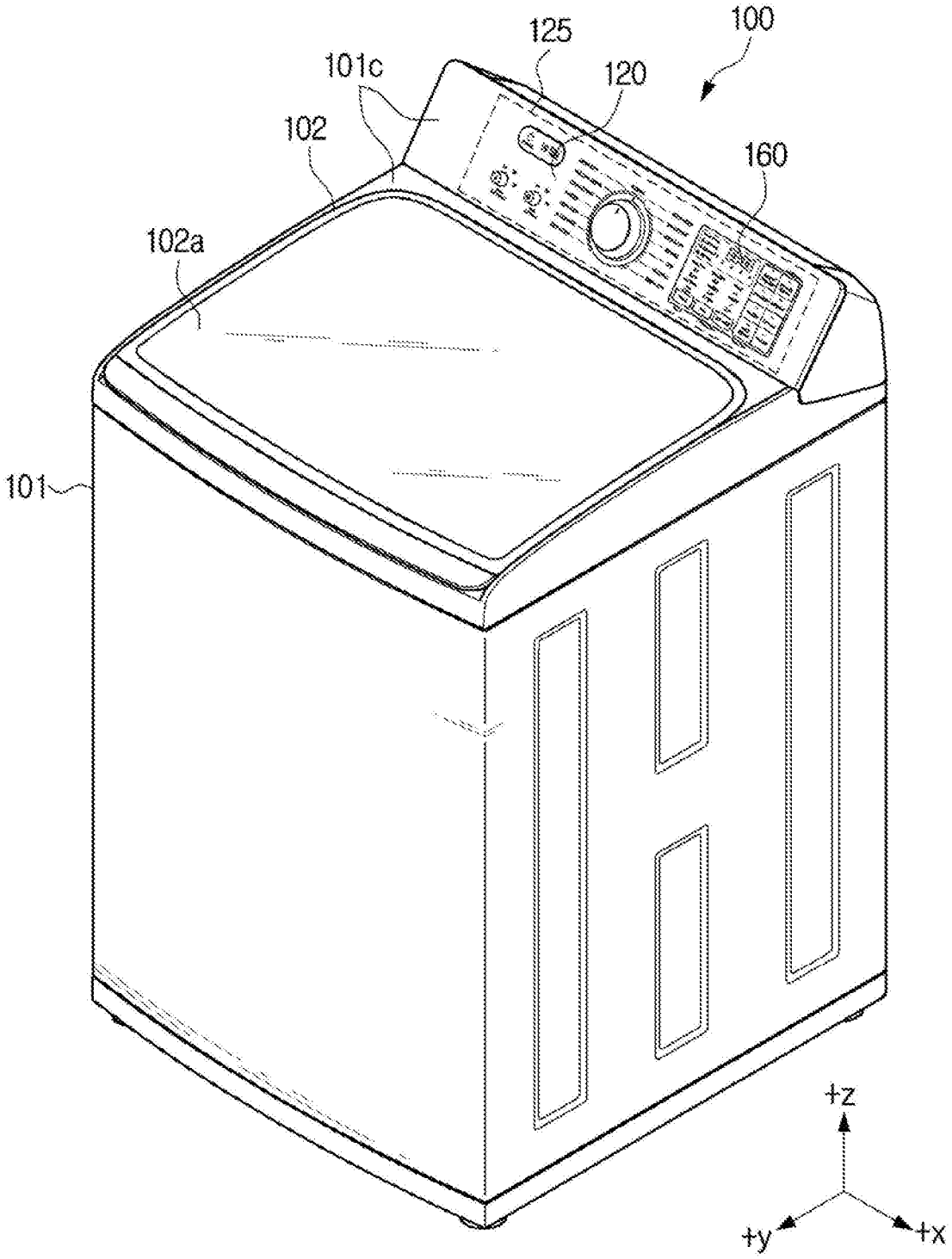
FIGS. 1A and 1B are schematic perspective views illustrating a washing machine according to one embodiment of the present disclosure.

Hereinafter exemplary embodiments of the present disclosure will be described in detail with reference to the accompanying drawings. The same reference numerals or signs shown in the drawings of the present disclosure indicate elements or components performing substantially the same function It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

Also, the terms used herein are used to describe the embodiments and are not intended to limit and/or restrict the present disclosure. The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

The same reference numerals or signs shown in the drawings of the present disclosure indicate elements or components performing substantially the same function. Hereinafter the present disclosure will be described more fully hereinafter with reference to the accompanying drawings.

Figure 1B:
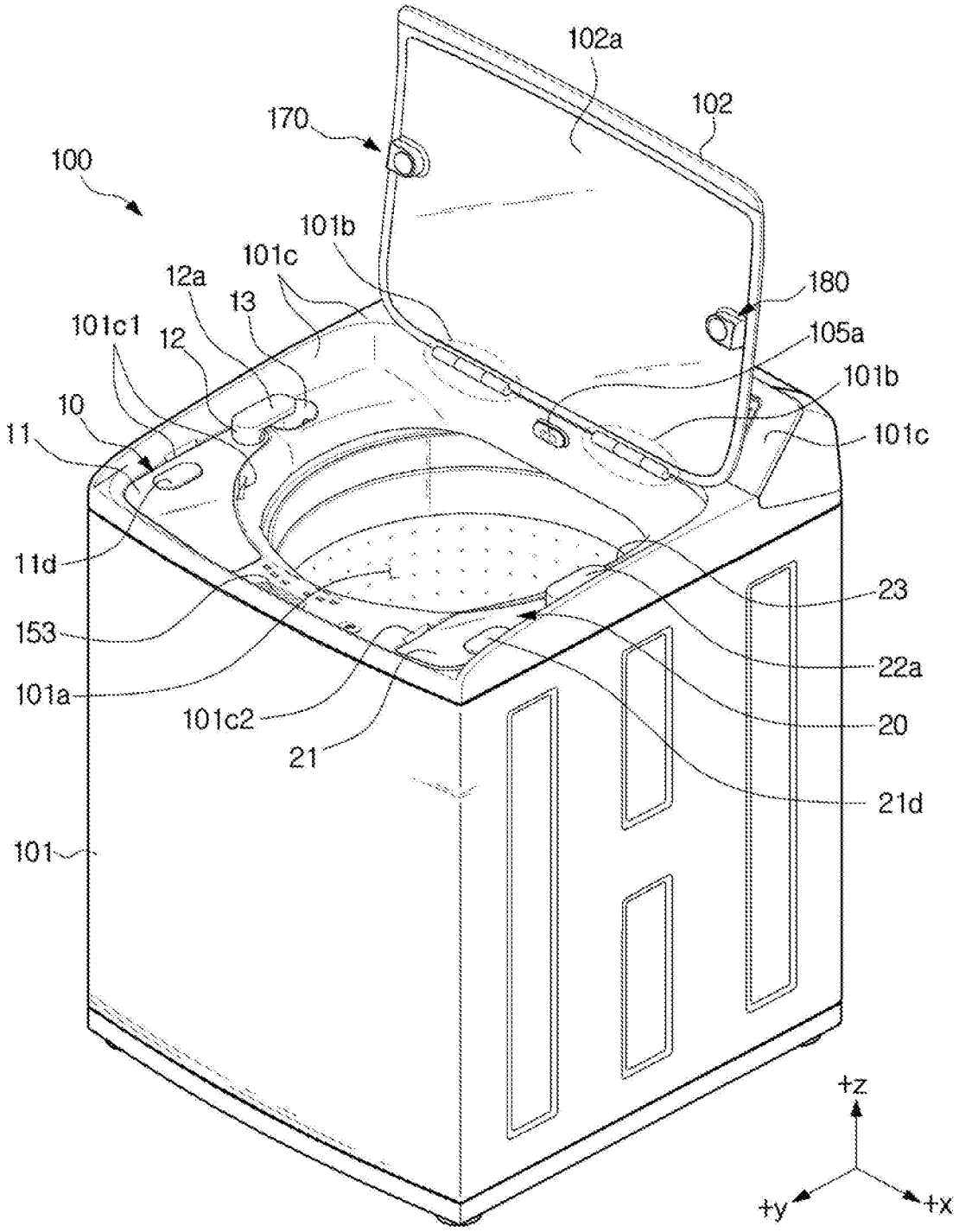

FIGS. 1A and 1B are schematic perspective views illustrating a washing machine according to one embodiment of the present disclosure.

Figure 2:
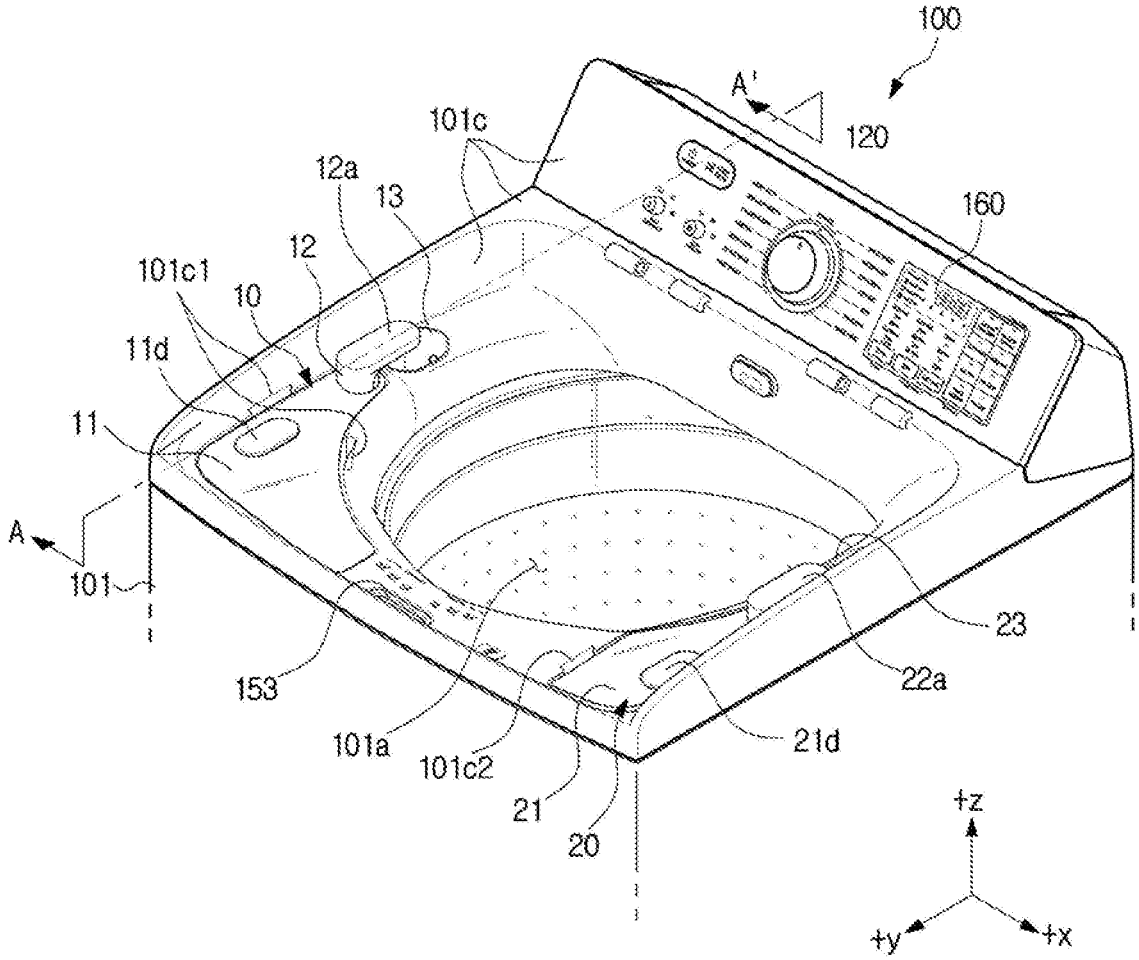
FIG. 2 is a schematic perspective view illustrating a detergent supply unit and a softening agent supply unit according to one embodiment of the present disclosure.

FIG. 2 is a schematic perspective view illustrating a detergent supply unit and a softening agent supply unit according to one embodiment of the present disclosure.

Referring to FIGS. 1A to 2, a washing machine 100 includes a body 101 forming an outer appearance, and a door 102 located at an upper portion 101*c* of the body 101 and configured to be opened and closed by a hinge 101*b*.

The body 101 includes a stationary tub 103*b* configured to store washing water (refer to FIG. 6A) and a rotary tub 103*a* (refer to FIG. 6A) configured to rotate clockwise or counterclockwise inside the stationary tub 103*b*. The above mentioned stationary tub 103*b* and rotary tub 103*a* may be referred to as a washing tub 103.

The washing machine 100 may include a water supply unit 141 (refer to FIG. 3) configured to supply washing water (for example, cold water and hot water) to the inside of the body 101, and a detergent supply unit 10 coupled to a detergent dispenser 11 and configured to mix washing water, which is supplied from the water supply unit 141, with a detergent so as to supply the mixed water to the rotary tub 103*a*. Further, the washing machine 100 may include a softening supply unit 20 coupled to a softening agent dispenser 21 storing softening agents, and configured to mix washing water, which is supplied from the water supply unit 141, with a softening agent so as to supply the mixed water to the rotary tub 103*a*.

An opening 101*a* for putting and taking out of the laundry may be formed in an upper portion 101*c* of the body 101 (for example, a portion thereof is covered by the door 102 and another portion thereof is not covered by the door 102). The opening 101*a* may be opened and closed by the door 102.

An inputter 120 including a plurality of operation buttons (for example, a power button, and an operation button) and function buttons (for example, a washing course and a washing option) and/or a display 160 displaying an operation and a state of the washing machine 100 may be located on an upper surface of the door 102. Alternatively, one of the inputter 120 and the display 160 may be installed on the upper portion 100*c* of the body 101. The inputter 120 and the display 160 may be referred to as an operation panel (OPE) 125.

The stationary tub 103*b* is installed inside the body 101, the rotary tub 103*a* is installed inside the stationary tub 103*b*, and a pulsator (not shown) to generate a water current is installed on the bottom of the rotary tub 103*a*.

A motor (not shown) configured to drive the rotary tub 103*a* and the pulsator (not shown), and a drainage unit (not shown) configured to discharge washing water, which is contaminated after being used for washing, to the outside may be installed on the bottom of the stationary tub 103*b* (for example, a lower portion of the body 101).

The washing machine 100 may perform washing of laundry filled in the rotary tub 103*a* by using detergents (or, cleaners and softening agents) and washing water through the pulsator (not shown) that is rotated by a driving force of the motor (not shown).

During washing, the washing machine 100 may perform rinsing by repeatedly supplying washing water (or supplying washing water and softening agents) and by discharging contaminated water. When the rinsing is completed, the washing machine 100 may discharge the contaminated washing water (or washing water) to the outside through the drainage unit (not shown). When the discharge is completed, the washing machine 100 may rotate the rotary tub 103*a* at a high speed to dewater the washing water remaining in the laundry.

A door sensor (or a door switch) 153 configured to detect the opening and closing of the door 102 may be positioned on the upper portion of the body 101. The door sensor 153 may be located at the door 102. The door sensor 153 may be provided in plural (for example, one door sensor is positioned in front of the door 102 (for example, a +y axis direction) and remaining door sensors 153 are positioned in rear of the door 102 adjacent to the hinge 101*b* (for example, a −y axis direction).

A detergent container 105 may be positioned in the upper portion of the body 101 (for example, under the door 102 and above the washing tub 103), and the detergent container 105 is provided with a discharge port 105*a* configured to discharge detergent mixed water and/or softening agent mixed water to the rotary tub 103*a*. Washing water supplied from the water supply unit 141 may be discharged through the discharge port 105*a* of the detergent container 105.

The door 102 may include a door glass 102*a* occupying a certain area. The door glass 102*a* may include a transparent material (for example, acrylic, plastic, and glass) that allows a user to check the inside of the body 101 under the door 102.

A detergent pump driver 170 may be provided, and the detergent pump driver 170 is installed on one side of the bottom surface of the door 102 and configured to, when the door 102 covers the opening 102*a*, drive (pump) a detergent pump 12, which is positioned in the detergent dispenser 11, by using a power. A distance (or gap) between the detergent pump 12 and the detergent pump driver 170 may vary according to opening and closing of the door 102. For example, a distance (or gap) between the detergent pump 12 and the detergent pump driver 170 when the door 102 closes the opening 102*a* is less (shorter) than a distance (or gap) between the detergent pump 12 and the detergent pump driver 170 when the door 102 opens the opening 102*a*. The detergent pump driver (or driver) 170 may be contained in the detergent supply unit 10.

A softening agent pump driver 180 may be provided, and the softening agent pump driver 180 is installed on the other side of the bottom surface of the door 102 and configured to drive (pump) a softening agent pump 22, which is contained in the softening agent dispenser 21, by using a power. A distance (or gap) between the softening agent pump 22 and the softening agent pump driver 178 may vary according to opening and closing of the door 102. For example, a distance (or gap) between the softening agent pump 22 and the softening agent pump driver 180 when the door 102 closes the opening 102*a* is less (shorter) than a distance (or gap) between the softening agent pump 22 and the softening agent pump driver 180 when the door 102 opens the opening 102*a*. The softening agent pump driver (or driver) 180 may be contained in the softening agent supply unit 20. The detergent pump driver 170 and the softening agent pump driver 180 will be described later.

Between the door 120 and the opening 101*a* of the body 101, an auxiliary door (not shown) may be arranged. The auxiliary door corresponds to washing (for example, hand wash or rough washing) which is performed independently of the washing performed in the washing tub 103. In a washing machine provided with the auxiliary door (not shown), the auxiliary door (not shown) may be referred to as a second door, and the door 120 may be referred to as a first door. The washing machine provided with the auxiliary door (not shown) may include an auxiliary water supply port (not shown) configured to supply washing water to the auxiliary door (not shown).

Figure 3A:
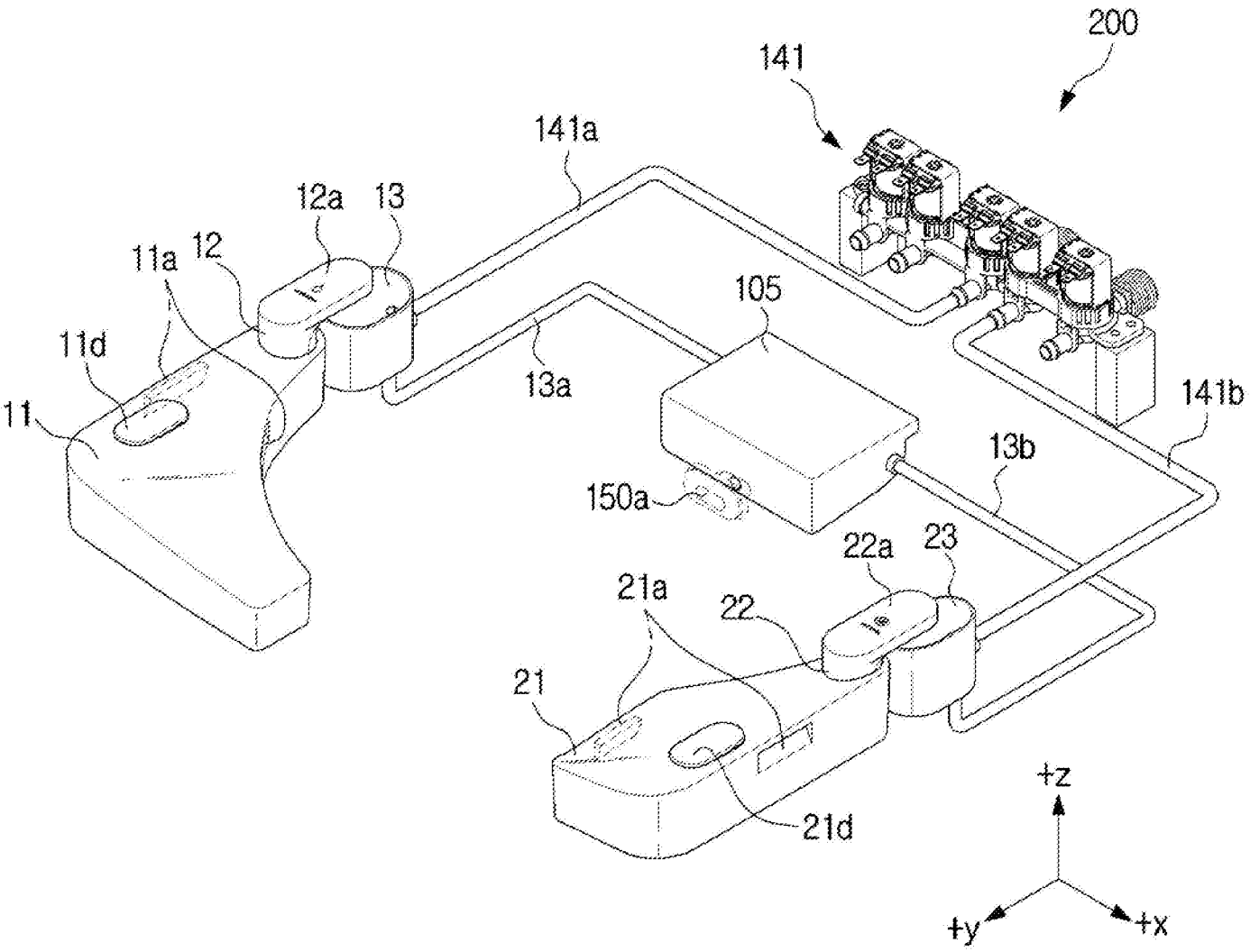
FIG. 3A is a schematic perspective view illustrating a supply assemble according to one embodiment of the present disclosure.
Figure 3B:
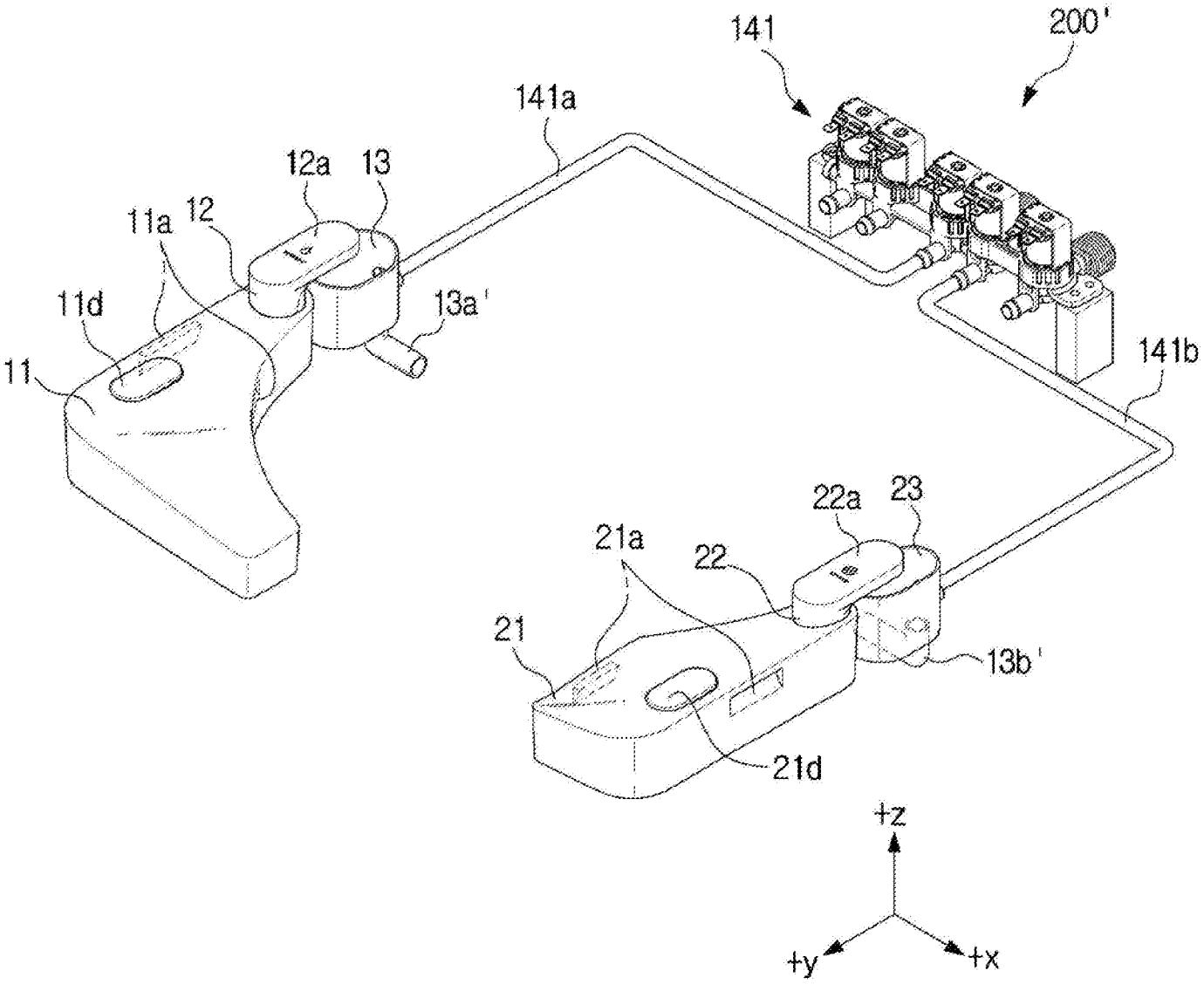
FIG. 3B is a schematic perspective view illustrating a supply assemble according to another embodiment of the present disclosure.

FIG. 3A is a schematic perspective view illustrating a supply assemble according to one embodiment of the present disclosure. FIG. 3B is a schematic perspective view illustrating a supply assemble according to another embodiment of the present disclosure.

Figure 4A:
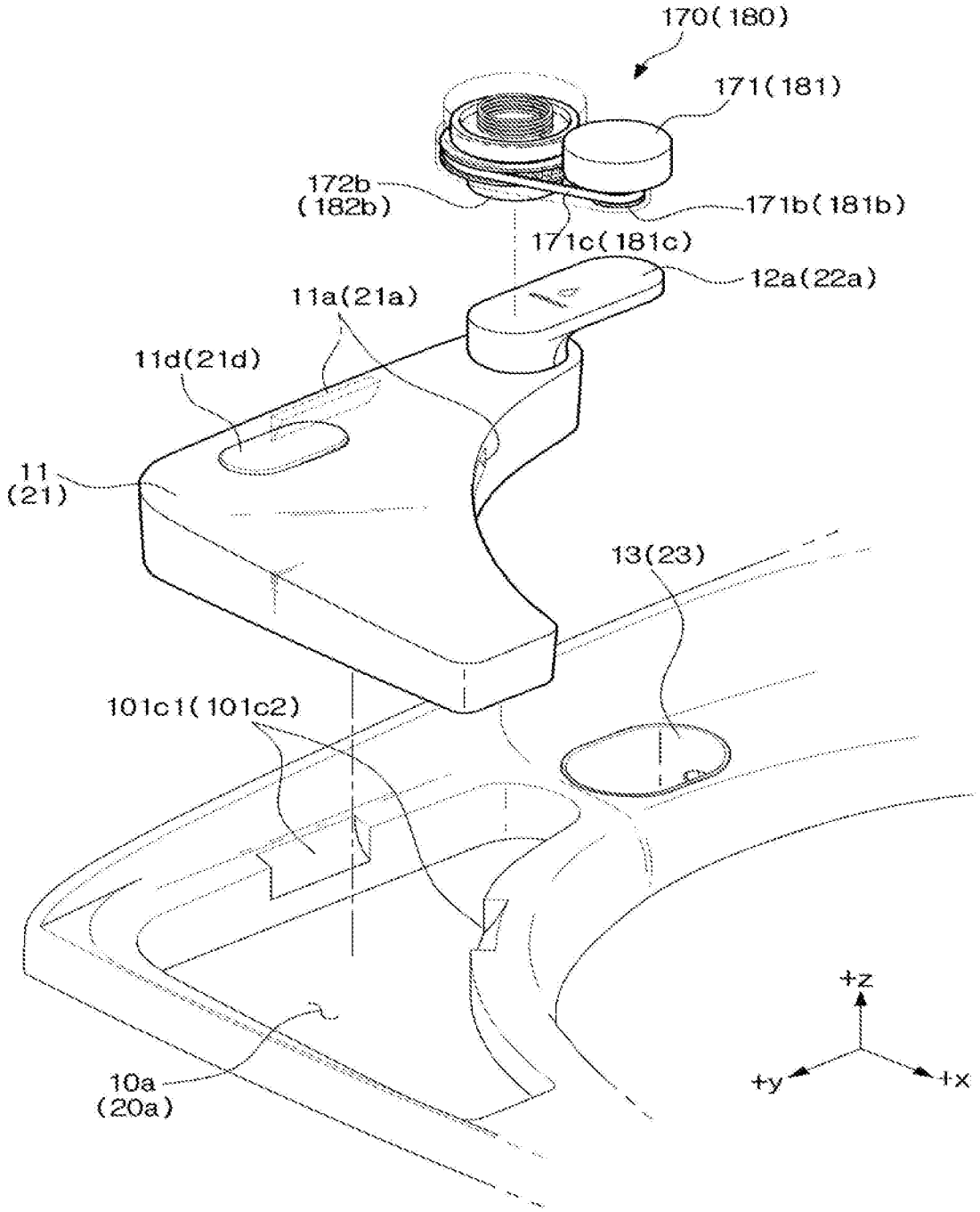
FIG. 4A is a schematic perspective view illustrating a detergent dispenser (a softening agent dispenser) and the detergent supply unit (the softening agent supply unit) according to one embodiment of the present disclosure.
Figure 4B:
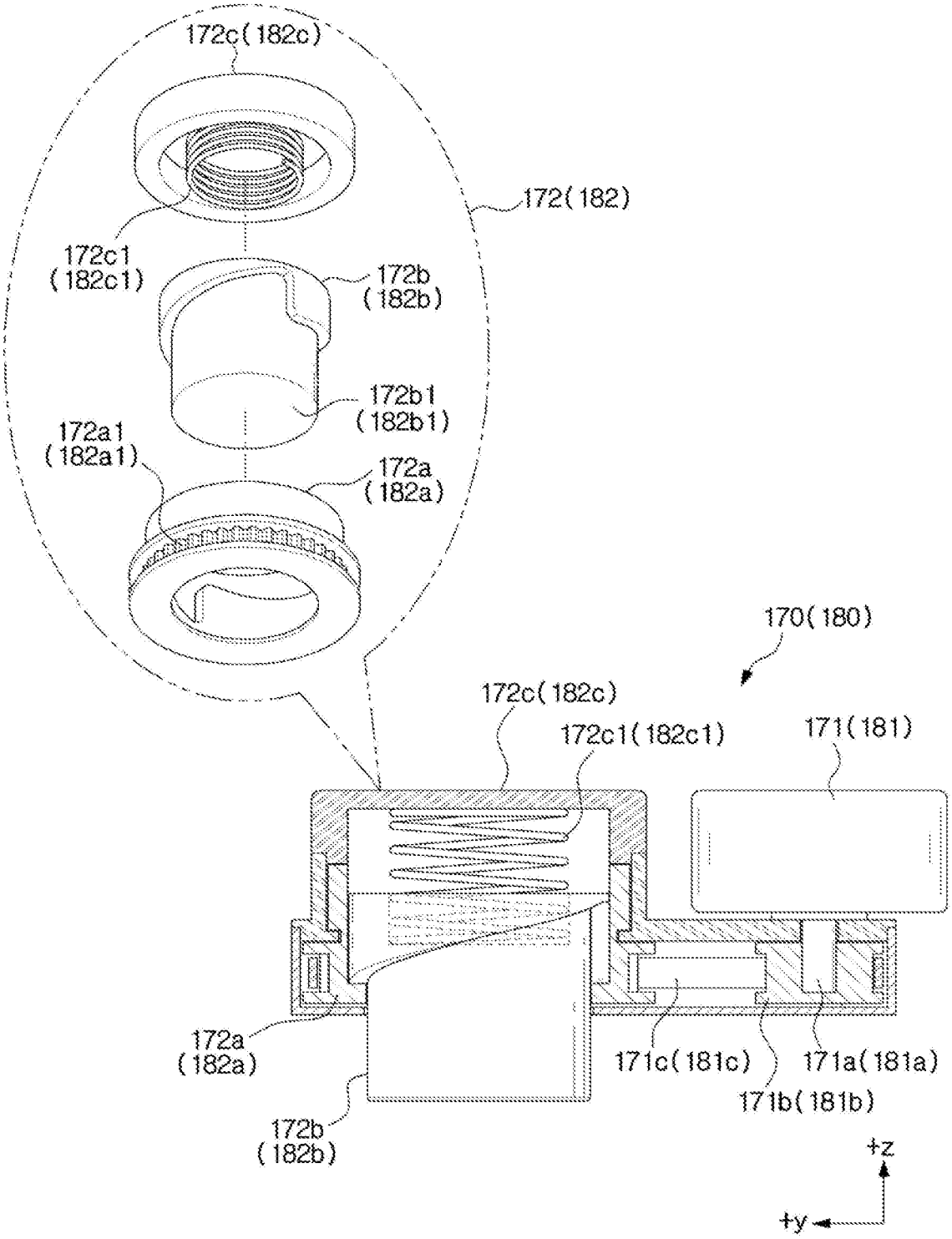
FIG. 4B is a schematic exploded perspective view illustrating the detergent supply unit including a detergent supply pump, a motor and a belt according to one embodiment of the present disclosure.

FIG. 4A is a schematic perspective view illustrating a detergent dispenser (a softening agent dispenser) and the detergent supply unit (the softening agent supply unit) according to one embodiment of the present disclosure. FIG. 4B is a schematic exploded perspective view illustrating the detergent supply unit including a detergent supply pump, a motor and a belt according to one embodiment of the present disclosure.

Referring to FIGS. 3A, 4A and 4B, a supply assembly 200 configured to supply detergent mixed water and softening agent mixed water to the washing tub 103 is provided. Alternatively, a supply assembly 200 configured to supply detergents and softening agents to the washing tub 103 may be provided. The supply assembly 200 may include one of the detergent supply unit 10 and the softening agent supply unit 20.

The supply assembly 200 may include only the detergent supply unit 10 configured to supply the detergent mixed water to the washing tub 103. The supply assembly 200 may further include a bleach supply unit (not shown). In addition, one of the detergent supply unit 10 and the softening agent supply unit 20 in the supply assembly 200 may be replaced by the bleach supply unit (not shown).

The supply assembly 200 may include the detergent supply unit 10, the softening agent supply unit 20, the water supply unit 141, water supply hoses 141*a* and 141*b*, mixed water hoses 13*a* and 13*b* and the detergent container 105. The components of the supply assembly 200 described above may be further added, removed, or modified.

The difference between the detergent supply unit 10 and the softening agent supply unit 20 may represent the difference of the detergent or softening agent contained in the dispenser 11 and 21. A dispenser storing detergents is the detergent dispenser 11 and a dispenser storing softening agents is the softening agent dispenser 21. In addition, a dispenser storing bleach is a bleach dispenser (not shown). The above mentioned description has been described with respect to the detergent supply unit 10 and the description may be applied to the softening agent supply unit 20 corresponding to the detergent supply unit 10.

As for the detergent supply unit 10, the detergent dispenser 11 may be positioned (for example, mounted/separated) in an accommodating portion 10*a* formed in the upper portion 101*c* of the body 101. The detergent dispenser 11 positioned in the accommodating portion 10*a* may be inserted and fixed to the inside of the accommodating portion 10*a*. The detergent dispenser 11 positioned in the accommodating portion 10*a* may be fixed by one protrusion or a plurality of protrusions (not shown) provided inside the accommodating portion 10*a*.

A detergent mixing tub 13 separated from the accommodating portion 10*a* may be formed on one side (for example, the −y axis direction) of the accommodating portion 10*a*.

The detergent dispenser 11 accommodating the detergent may include a groove 11*a* which a user can grasp and a cap 11*d* covering a detergent supplement port (not shown). The detergent pump 12 may be coupled to the detergent dispenser 11. A detergent suction pipe 12*b* (refer to FIG. 5A) of the detergent pump 12 may be in contact with (or in direct contact with) the detergent accommodated in the detergent dispenser 11.

The detergent dispenser 11 may include a transparent material (for example, acrylic, plastic, and glass) that allows a user to check a remaining amount of the detergent and to check the inside thereof. The user can intuitively confirm the remaining amount of the detergent contained in the detergent dispenser 11 that is a transparent material.

The detergent supply unit 10 may include the detergent mixing tub 13 (or a first mixing tub) provided in the housing 10*a* and in which a detergent is mixed with washing water. Some of the detergents contained in the detergent dispenser 11 is sucked through the detergent suction pipe 12*b* of the detergent pump 12 and supplied to the detergent mixing tub 13 through a supply path 12*i* (refer to FIG. 5A) inside a pump handle 12*a*. The detergent passed through the supply path 12*i* (refer to FIG. 5A) in the pump handle 12*a* may fall into the detergent mixing tub 13 through a detergent outlet 12*h* (refer to FIG. 5A). A length of the supply path 12*i* of the detergent, which is supplied to the detergent mixing tub 13, may be shortened (reduced) due to the fall of the detergent. By reducing the length of the supply path 12*i* of the detergent, it is possible to prevent the detergent from being stuck (for example, the supplied detergent is stuck to the inside without being diluted).

The detergent dispenser 11 positioned in the accommodating portion 10*a* may be separated from the detergent supply unit 10 by the user's gripping. The detergent dispenser 11 positioned in the accommodating portion 10*a* may be separated from the detergent supply unit 10 when a user grips the groove 11*a*.

In the driver 170, the driving force of the motor 171 may be transmitted to the detergent pump 12 through a drive shaft 171*a*, a pulley 171*b*, a belt 171*c*, a rotary cam top 172*a* and a rotary cam bottom 172*b*. The driving force of the motor 171 may be transmitted to the rotary cam top 172*a* connected to the pulley 171*b* of the drive shaft 171*a* (for example, transmission by a gear, transmission through coupling, or transmission by a belt). An operation (or rotation) of the rotary cam top 172*a* and an operation (or (vertical) reciprocating motion) of the rotary cam bottom 172*b* may start according to the driving force transmitted from the motor 171. An operation (for example, (vertical) reciprocating motion) of the handle 12*a* of the detergent pump 12 may be performed by the operation (or (vertical) reciprocating motion) of the rotary cam bottom 172*b*. The rotation of the motor 171 may be converted to the reciprocating motion of the rotary cam 172. Detailed descriptions will be described later.

The motor 171 may be positioned at one side of the rotary cam top 172*a*. With respect to the rotary cam top 172, one side may include one of the −y axis direction, the +x axis direction, and the +y axis direction. With respect to the rotary cam top 172, a position of the motor 171 may be located between 0° (for example, the y-axis direction) and 180° (for example, the +y-axis direction) that is clockwise. Alternatively, with respect to the rotary cam top 172, a position of the motor 171 may be located between 0° (for example, the y-axis direction) and 210° (for example, the +y-axis direction) that is clockwise, and thus the motor 171 may be located in a position that does not interfere with the upper portion 101*c* of the body 101.

The detergent of the detergent dispenser 11 may be pumped by power pumping by the operation of the detergent pump 12, which is by the driving force of the motor 171, and the pumped detergent may be provided to the detergent mixing tub 13.

The detergent mixing tub 13 may receive washing water supplied via the water supply unit 141 and the water supply hose 141*a*, as well as the detergent. The detergent and the washing water may be mixed (or diluted) in the detergent mixing tub 13 to become detergent mixed water. The detergent mixed water formed in the detergent mixing tub 13 passes the mixed water hose 13*a* connected to the lower portion of the detergent mixing tub 13, and then discharged to the washing tub 103 through the discharge port 105*a* of the detergent container 105. In addition, the water supply unit 141 may supply washing water directly to the detergent container 105 through a water supply hose (not shown).

The detergent mixed water may be discharged through an outlet 13*c*2 due to a difference in height between an inlet 13*c*1 (refer to FIG. 5A) of the water supply hose 141*a* connected to one side of the detergent mixing tub 13 and the outlet 13*c*2 (refer to FIG. 5A) of the mixed water hose 13*a* connected to the lower portion of the detergent mixing tub 13.

The detergent dispenser 11 may be separated from the accommodating portion 10*a*. When a user adds the detergent to the detergent dispenser 11 and/or a user cleans the detergent dispenser 11, the detergent dispenser 11 may be separated from the accommodating portion 10*a* by the user. Further, the detergent dispenser 11 may be mounted to the accommodating portion 10*a*.

In a state in which the detergent dispenser 11 is mounted to the accommodating portion 10*a*, the groove 11*a* of the detergent dispenser 11 may be exposed through an accommodating portion groove 101*c*1 between the accommodating portion 10*a* and the washing machine upper portion 101*c*. A user may separate the detergent dispenser 11 from the accommodating portion 10*a* by gripping the groove 11*a* of the detergent dispenser 11 and lifting the detergent dispenser 11 upward (for example, the +z axis direction).

An elastic member (for example, a spring, (not shown)) may be provided on the bottom of the accommodating portion 10*a*. When the detergent dispenser 11 is lifted upward, the elastic member (not shown) positioned at the bottom of the accommodating portion 10*a* may provide an elastic force to the detergent dispenser 11.

As for the softening agent supply unit 20, the softening agent dispenser 21 may be positioned (for example, mounted/separated) in an accommodating portion 20*a* formed in the upper portion 101*c* of the body 101. The softening agent dispenser 21 positioned in the accommodating portion 20*a* may be inserted and fixed to the inside of the accommodating portion 20*a*. The softening agent dispenser 21 positioned in the accommodating portion 20*a* may be fixed by one protrusion or a plurality of protrusions (not shown) provided inside the accommodating portion 20*a*.

A softening agent mixing tub 23 separated from the accommodating portion 20*a* may be formed on one side (for example, the −y axis direction) of the accommodating portion 20*b*.

The softening agent dispenser 21 accommodating the softening agent may include a groove 11*a* which a user can grasp and a cap 21*d* covering a softening agent supplement port (not shown). The softening agent pump 22 may be coupled to the softening agent dispenser 21. A softening agent suction pipe 22*b* (refer to FIG. 5A) of the softening agent pump 22 may be in contact with the softening agent accommodated in the softening agent dispenser 21.

The softening agent dispenser 21 may include a transparent material (for example, acrylic, plastic, and glass) that allows a user to check a remaining amount of the softening agent and to check the inside thereof. The user can intuitively confirm the remaining amount of the softening agent contained in the softening agent dispenser 21 that is a transparent material.

The softening agent supply unit 20 may include the softening agent mixing tub 23 (or a second mixing tub) provided in the housing 20*a* and in which a softening agent is mixed with washing water. Some of the softening agents contained in the softening agent dispenser 21 is sucked through the softening agent suction pipe 22*b* of the softening agent pump 22 and supplied to the softening agent mixing tub 23 through a supply path 22*i* (refer to FIG. 5A) inside a pump handle 22*a*. The softening agent passed through the supply path 22*i* (refer to FIG. 5A) in the pump handle 22*a* may fall into the softening agent mixing tub 23 through a softening agent outlet 22*h* (refer to FIG. 5A). A length of the supply path 22*i* of the softening agent, which is supplied to the softening agent mixing tub 23, may be shortened (reduced) due to the fall of the refrigerant. By reducing the length of the supply path 22*i* of the softening agent, it is possible to prevent the softening agent from being stuck (for example, the supplied softening agent is stuck to the inside without being diluted).

The softening agent dispenser 21 positioned in the accommodating portion 20*a* may be separated from the softening agent supply unit 20 by the user's gripping. The softening agent dispenser 21 positioned in the accommodating portion 20*a* may be separated from the softening agent supply unit 20 when a user grips the groove 21*a*.

In the driver 180, the driving force of the motor 181 may be transmitted to the softening agent pump 22 through a drive shaft 181*a*, a pulley 181*b*, a belt 181*c*, a rotary cam top 182*a* and a rotary cam bottom 182*b*. The driving force of the motor 181 may be transmitted to the rotary cam top 182*a* connected to the pulley 181*b* of the drive shaft 181*a* (for example, transmission by a gear, transmission through coupling, or transmission by a belt). An operation (or rotation) of the rotary cam top 182*a* and an operation (or (vertical) reciprocating motion) of the rotary cam bottom 182*b* may start according to the driving force transmitted from the motor 181. An operation (for example, (vertical) reciprocating motion) of the handle 22*a* of the softening agent pump 22 may be performed by the operation (or (vertical) reciprocating motion) of the rotary cam bottom 182*b*. The rotation of the motor 181 may be converted to the reciprocating motion of the rotary cam 182. Detailed descriptions will be described later.

The motor 172 may be positioned at one side of the rotary cam top 182*a*. With respect to the rotary cam top 182, one side may include one of the −y axis direction, the −x axis direction, and the +y axis direction. With respect to the rotary cam top 182*a*, a position of the motor 181 may be located between 0° (for example, the −y axis direction) and 180° (for example, the +y axis direction) that is counterclockwise. Alternatively, with respect to the rotary cam top 182*a*, a position of the motor 181 may be located between 0° (for example, the −y axis direction) and 210° that is counterclockwise, and thus the motor 181 may be located in a position that does not interfere with the upper portion 101*c* of the body 101.

The softening agent of the softening agent dispenser 21 may be pumped by power pumping by the operation of the softening agent pump 22, which is by the driving force of the motor 181, and the pumped softening agent may be provided to the softening agent mixing tub 23.

As well as the softening agent, the softening agent mixing tub 23 may receive washing water supplied via the water supply unit 141 and the water supply hose 141*b*. The softening agent and the washing water may be mixed (or diluted) in the softening agent mixing tub 23 to become softening agent mixed water. The softening agent mixed water formed in the softening agent mixing tub 23 passes the mixed water hose 13*b* connected to the lower portion of the softening agent mixing tub 23, and then discharged to the washing tub 103 through the discharge port 105*a* of the detergent container 105. The softening agent mixed water may be discharged through an outlet 23*c*2 due to a difference in height between an inlet 23*c*1 (refer to FIG. 5A) of the water supply hose 141*b* connected to one side of the softening agent mixing tub 13 and the outlet 23*c*2 (refer to FIG. 5A) of the mixed water hose 13*b* connected to the lower portion of the softening agent mixing tub 23.

The softening agent dispenser 21 may be separated from the accommodating portion 20*a*. When a user adds the softening agent to the softening agent dispenser 21 and/or a user cleans the softening agent dispenser 21, the softening agent dispenser 21 may be separated from the accommodating portion 20*a* by the user. Further, the softening agent dispenser 21 may be mounted to the accommodating portion 20*a*.

In a state in which the softening agent dispenser 21 is mounted to the accommodating portion 20*a*, the groove 21*a* of the softening agent dispenser 21 may be exposed through an accommodating portion groove 101*c*2 between the accommodating portion 20*a* and the washing machine upper portion 101*c*. A user may separate the softening agent dispenser 21 from the accommodating portion 20*a* by gripping the groove 21*a* of the softening agent dispenser 21 and lifting the softening agent dispenser 21 upward (for example, the +z axis direction).

An elastic member (for example, a spring (not shown)) may be provided on the bottom of the accommodating portion 20*a*. When the softening agent dispenser 21 is lifted upward, the elastic member (not shown) positioned at the bottom of the accommodating portion 20*a* may provide an elastic force to the softening agent dispenser 21.

Referring to FIG. 3B illustrating another embodiment of the present disclosure, a supply assembly 200' configured to supply detergent mixed water and softening agent mixed water to a washing tub 103 is provided. Alternatively, a supply assembly 200' configured to supply detergents and softening agents to the washing tub 103 may be provided. The supply assembly 200 may include one of a detergent supply unit 10 and a softening agent supply unit 20.

The supply assembly 200' may include the detergent supply unit 10, the softening agent supply unit 20, a water supply unit 141, water supply hoses 141*a* and 141*b*, and mixed water hoses 13*a*' and 13*b*'. The supply assembly 200' of FIG. 3B may exclude the detergent container 105 from the supply assembly 200 of FIG. 3A. In the supply assembly 200' of FIG. 3B without the detergent container 105, the detergent mixed water may be directly discharged to the washing tub 130 through the mixed water hose 13*a*'. Further, the softening agent mixed water may be directly discharged to the washing tub 130 through the mixed water hose 13*b*'.

A length of the mixed water hoses 13*a*' and 13*b*' in the supply assembly 200' of FIG. 3B may be less than a length of the mixed water hoses 13*a* and 13*b* in the supply assembly 200 of FIG. 3A (for example, 50% or less of the length of the mixed water hoses 13*a* and 13*b*). In addition, in response to the rapid discharge of the mixed water, a diameter of the mixed water hoses 13*a*' and 13*b*' of FIG. 3B may be greater than a diameter of the mixed water hoses 13*a* and 13*b* of FIG. 3A (for example, 5% or greater of the diameter of the mixed water hoses 13*a* and 13*b*).

The remaining components of the supply assembly 200' except for the above mentioned mixed water hoses 13*a*' and 13*b*' and detergent container 105 may be practically same as the components of the supply assembly 200 of FIG. 3A and thus redundant description will be omitted.

Figure 5A:
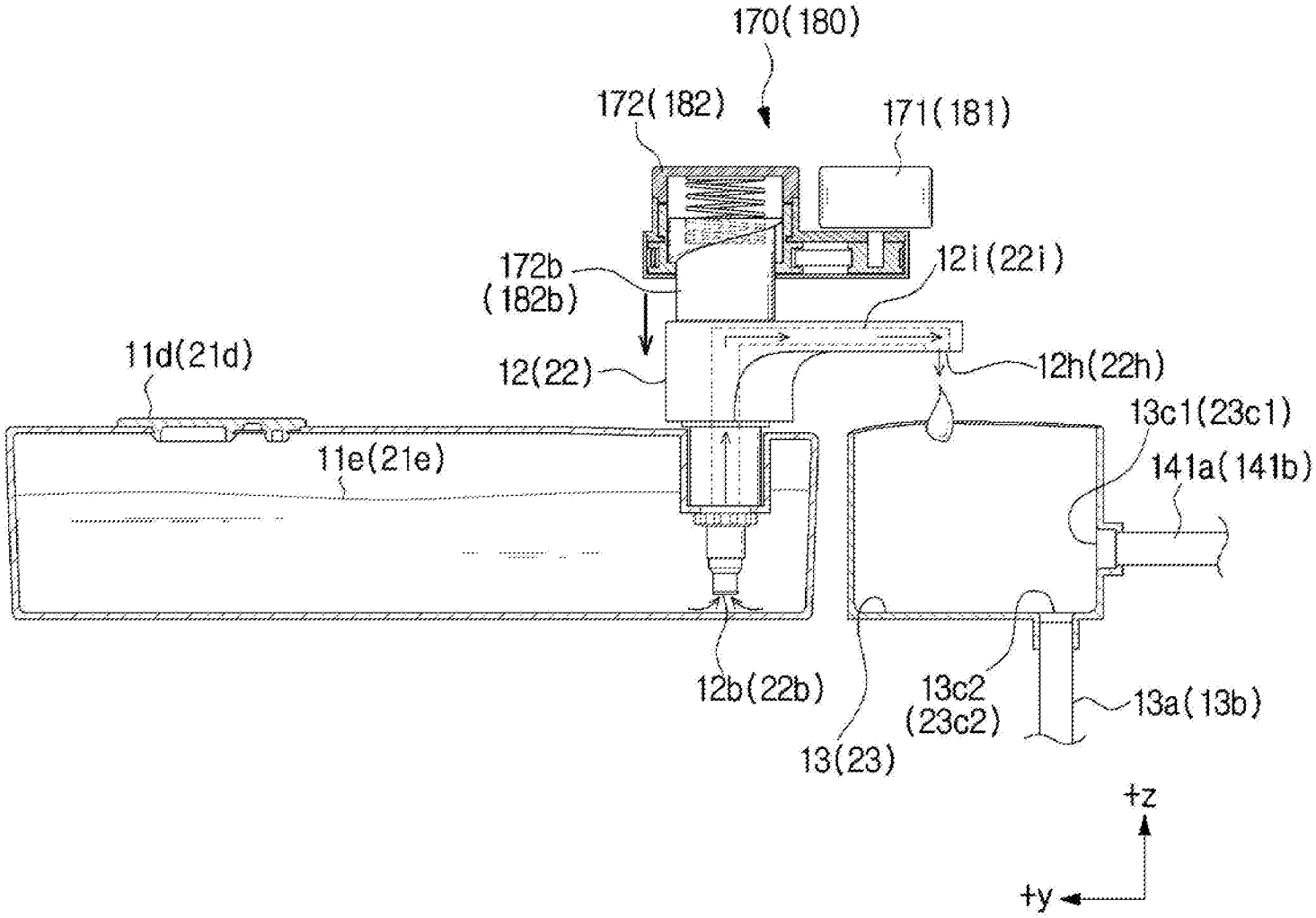
FIGS. 5A and 5B are schematic cross-sectional views illustrating the detergent supply unit automatically supplying a detergent by the pump connected to the motor according to one embodiment of the present disclosure.
Figure 5B:
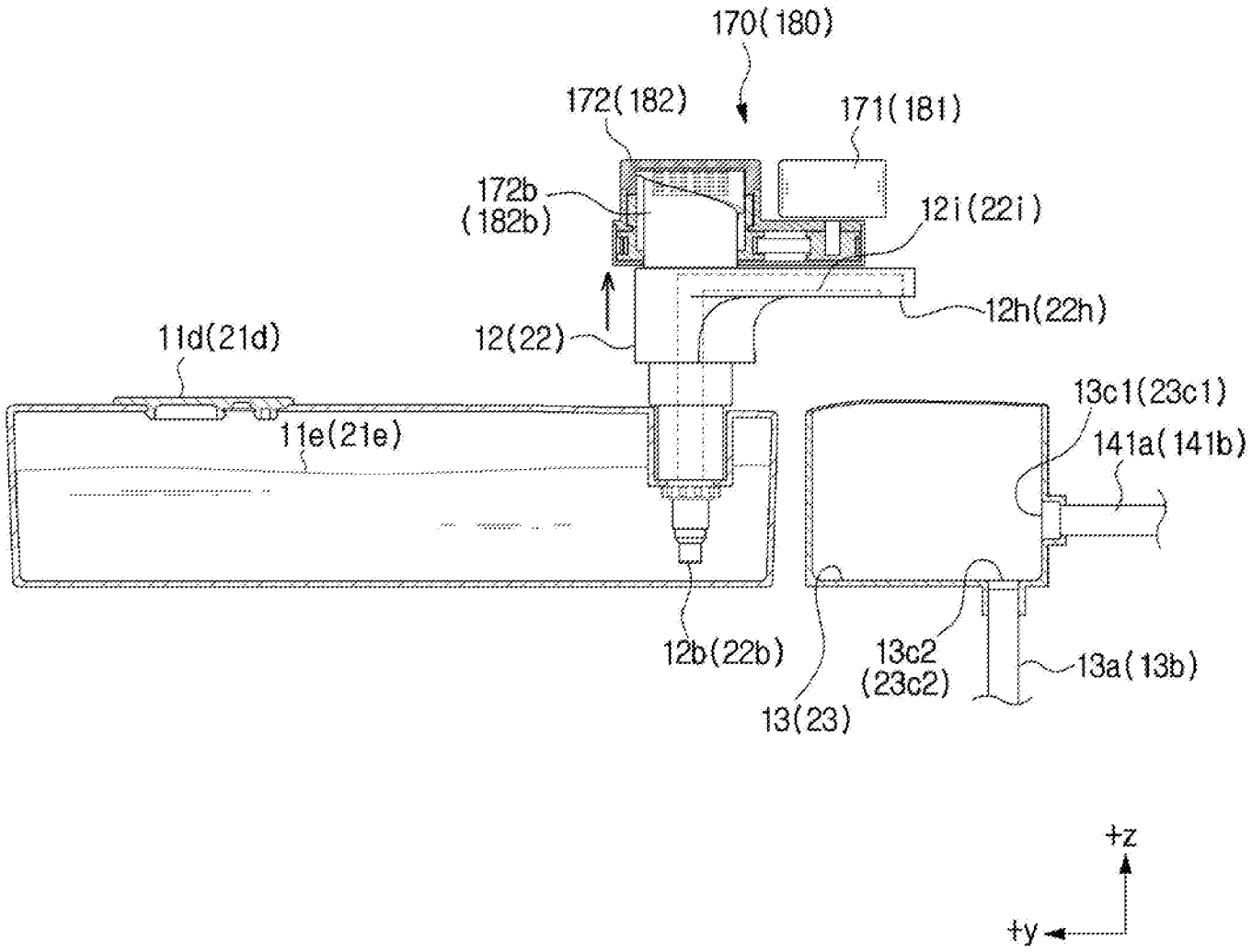

FIGS. 5A and 5B are schematic cross-sectional views illustrating the detergent supply unit automatically supplying a detergent by the pump connected to the motor according to one embodiment of the present disclosure.

The detergent supply unit 10 configured to supply automatically (or by power) detergents to the detergent mixing tub 13 will be described with reference to FIGS. 5A and 5B.

In a state in which laundry is positioned in the washing tub 103 and the door 102 covers the opening 101*a* in the upper portion 101*c* of the body 101, a user can input a washing course (for example, a standard course) and an option (for example, washing time, and the number of rinsing)

When the weight of the laundry contained in the washing tub 103 is calculated, a controller (or processor that is not shown) may calculate an amount of at least one of the detergent, the softening agent and the bleach. When the weight of the laundry contained in the washing tub 103 is calculated, the motor 171 may be operated to supply the amount of the detergent to be supplied to the washing tub 103.

The driving force for operating the detergent pump 12 may be transmitted from the motor 171 of the detergent pump driver 170. The belt 171*c* in contact with the pulley 171*b* coupled to the drive shaft 171*a* of the motor 171 may rotate in the same direction as the rotation direction of the drive shaft 171*a*. The belt 171*c* may include a timing belt having grooves (or teeth). When the belt 171*c* is the timing belt, the pulley 171*b* may have grooves (or teeth) corresponding to the pitch of the timing belt. In addition, an outer surface of the rotary cam top 172*a* may have a groove 172*a*1 (or teeth) corresponding to the transmission of driving force through the timing belt.

The driving force of the motor 171 may be transmitted to the teeth 172*a*1 of the rotary cam top 172*a* through the rotation of the belt 171*c*. The rotary cam bottom 172*b* coupled to the rotary cam top 172*a*, which rotates in accordance with the driving force transmitted from the motor 171, may perform the reciprocating motion (or vertical reciprocating motion) in conjunction with rotation of the rotary cam top 172*a*.

The pump handle 12*a* of the detergent pump 12 in contact with (or temporarily contact) a bottom surface 172*b*1 of the rotary cam bottom may perform the reciprocating motion in accordance with the reciprocating motion of the rotary cam bottom 172*b*. A shaft of the detergent pump 12 (for example, connected to the detergent suction pipe 12*b*) in contact with (or temporarily contact) the bottom surface 172*b*1 of the rotary cam bottom may perform the reciprocating motion in accordance with the reciprocating motion of the rotary cam bottom 172*b*. For example, when the rotary cam bottom 172*b* moves upward (the +z axis direction) by the elastic force, the shaft of the detergent pump 12 (or the pump handle 12*a*) in contact with (or temporarily contact) the bottom surface 172*b*1 of the rotary cam bottom may move upward (the +z axis direction). Further, when the rotary cam bottom 172*b* moves downward (the −z axis direction) by the transmitted driving force, the shaft of the detergent pump 12 (or the pump handle 12*a*) in contact with (or temporarily contact) the bottom surface 172*b*1 of the rotary cam bottom may move downward (the −z axis direction).

The rotation direction of the drive shaft 171*a* of the motor 171, the rotation direction of the pulley 171*b*, the rotation direction of the belt 171*c*, and the rotation direction of the rotary cam top 172*a* may coincide with each other.

By the lowering of the pump handle 12*a* caused by the driving force, some 11*e* of the detergent contained in the detergent dispenser 11 may be supplied to the detergent mixing tub 13 through the supply path 12*i* and the detergent outlet 12*h* of the pump handle 12*a*. A height in which the some 11*e* of the detergent, which is to fall from the pump handle 12*a* to the detergent mixing tub 13, starts to fall may be higher than a height of the detergent mixing tub 13.

An amount of detergent that is supplied once by power pumping (or an amount of detergent supplied when the pump handle is stroked once from the highest point to the lowest point) may be 30 ml or more and 50 ml or less (or 100 ml or less, for example, an amount of the detergent supplied once may vary). The detergent dispenser 11 may contain 1000 ml of detergent. Alternatively, the detergent dispenser 11 may contain 300 ml or more and 3000 ml or less of detergent. The capacity of the detergent dispenser 11 may vary according to the size and structure of the washing machine 100.

When the lowering of the pump handle 12*a* is completed, the pump handle 12*a* may be linearly moved (for example, raised) by an elastic member 172*c*1 (for example, a spring). When the lowering of the pump handle 12*a* is completed, the pump handle 12*a* may be linearly moved (for example, raised) by the elastic member 172*c*1 (for example, a spring) and/or by the return of the rotary cam bottom 172*b*.

As the detergent motor 171 continuously rotates in one direction, the pump handle 12*a* may continuously perform a reciprocating motion (for example, move down and up). The detergent of the detergent dispenser 11 may be continuously supplied to the detergent mixing tub 13 through the supply path 12*i* and the detergent outlet 12*h* of the pump handle 12*a* by the continuous reciprocating motion (for example, lowering and lifting) of the pump handle 12*a* according to the continuous rotation of the detergent motor 171. The reciprocating motion of the pump handle 12*a* may be terminated in accordance with the termination of rotation of the detergent motor 171. Automatic detergent supply by the detergent pump 12 may be terminated upon termination of the rotation of the detergent motor 171.

When the driving force is transmitted from the detergent motor 171 (for example, when the door 102 is closed), it is difficult for the pump handle 12*a* to rotate clockwise or counterclockwise (for example, fixed to a first position 12*a*1 (refer to FIG. 6A)). When the driving force is not transmitted from the detergent motor 171 (for example, the door 102 is opened), the pump handle 12*a* may be rotated clockwise or counterclockwise by a user.

In the rinse cycle of laundry after washing, the motor 181 of the softening agent supply unit 20 may be operated based on the amount of the softening agent, which is to be supplied to the washing tub 103 (or calculated based on the weight of laundry).

The driving force for operating the softening agent pump 22 may be transmitted from the motor 181 of the softening agent pump driver 180. The belt 181*c* in contact with the pulley 181*b* coupled to the drive shaft 181*a* of the motor 181 may rotate in the same direction as the rotation direction of the drive shaft 181*a*. The belt 181*c* may include a timing belt having grooves (or teeth). When the belt 181*c* is the timing belt, the pulley 181*b* may have grooves (or teeth) corresponding to the pitch of the timing belt. In addition, an outer surface of the rotary cam top 182*a* may have a groove 182*a*1 (or teeth) corresponding to the transmission of driving force through the timing belt.

The driving force of the motor 181 may be transmitted to the teeth 182*a*1 of the rotary cam top 182*a* through the rotation of the belt 181*c*. The rotary cam bottom 182*b* coupled to the rotary cam top 182*a*, which rotates in accordance with the driving force transmitted from the motor 181, may perform the reciprocating motion (or vertical reciprocating motion) in conjunction with rotation of the rotary cam top 182*a*.

The pump handle 22*a* of the softening agent pump 22 in contact with (or temporarily contact) a bottom surface 182*b*1 of the rotary cam bottom may perform the reciprocating motion in accordance with the reciprocating motion of the rotary cam bottom 182*b*. A shaft of the softening agent pump 22 (for example, connected to the softening agent suction pipe 22*b*) in contact with (or temporarily contact) the bottom surface 182*b*1 of the rotary cam bottom may perform the reciprocating motion in accordance with the reciprocating motion of the rotary cam bottom 182*b*. For example, when the rotary cam bottom 182*b* moves upward (the +z axis direction) by the elastic force, the shaft of the softening agent pump 22 (or the pump handle 12*a*) in contact with (or temporarily contact) the bottom surface 182*b*1 of the rotary cam bottom may move upward (the +z axis direction). Further, when the rotary cam bottom 182*b* moves downward (the −z axis direction) by the transmitted driving force, the shaft of the softening agent pump 22 (or the pump handle 22*a*) in contact with (or temporarily contact) the bottom surface 182*b*1 of the rotary cam bottom may move downward (the −z axis direction).

The rotation direction of the drive shaft 181*a* of the motor 181, the rotation direction of the pulley 181*b*, the rotation direction of the belt 181*c*, and the rotation direction of the rotary cam top 182*a* may coincide with each other.

By the lowering of the pump handle 22*a* caused by the driving force, some 21*e* of the softening agent contained in the softening agent dispenser 21 may be supplied to the softening agent mixing tub 23 through the supply path 22*i* and the softening agent outlet 22*h* of the pump handle 22*a*. A height in which the some 21*e* of the softening agent, which is to fall from the pump handle 22*a* to the softening agent mixing tub 23, starts to fall may be higher than a height of the softening agent mixing tub 23.

An amount of softening agent that is supplied once by power pumping (or an amount of softening agent supplied when the pump handle is stroked once from the highest point to the lowest point) may be 30 ml or more and 50 ml or less (or 100 ml or less, for example, an amount of the softening agent supplied once may vary). The softening agent dispenser 21 may contain 800 ml of softening agent, which is less than the amount of the detergent contained in the detergent dispenser 11. Further, the softening agent dispenser 21 may contain 200 ml or more and 2500 ml or less of softening agent. The capacity of the softening agent dispenser 21 may vary according to the size and structure of the washing machine 100. The capacity of the softening agent dispenser 21 may be less than the capacity of the detergent dispenser 11.

When the lowering of the pump handle 22*a* is completed, the pump handle 22*a* may be linearly moved (for example, raised) by an elastic member 182*c*1 (for example, a spring). When the lowering of the pump handle 22*a* is completed, the pump handle 22*a* may be linearly moved (for example, raised) by the elastic member 182*c*1 (for example, a spring) and/or by the return of the rotary cam bottom 182*b*.

As the softening agent motor 181 continuously rotates in one direction, the pump handle 22*a* may continuously perform a reciprocating motion (for example, move down and up). The softening agent of the softening agent dispenser 21 may be continuously supplied to the softening agent mixing tub 23 through the supply path 22*i* and the softening agent outlet 22*h* of the pump handle 22*a* by the continuous reciprocating motion (for example, lowering and lifting) of the pump handle 22*a* according to the continuous rotation of the softening agent motor 181. The reciprocating motion (for example, lowering and lifting) of the pump handle 22*a* may be terminated in accordance with the termination of rotation of the softening agent motor 181. Automatic softening agent supply by the softening agent pump 22 may be terminated upon termination of the rotation of the softening agent motor 181.

When the driving force is transmitted from the softening agent motor 181 (for example, when the door 102 is closed), it is difficult for the pump handle 22*a* to rotate clockwise or counterclockwise (for example, fixed to a first position 22*a*1 (refer to FIG. 6A)). When the driving force is not transmitted from the softening agent motor 181 (for example, the door 102 is opened), the pump handle 22*a* may be rotated clockwise or counterclockwise by a user.

Figure 6A:
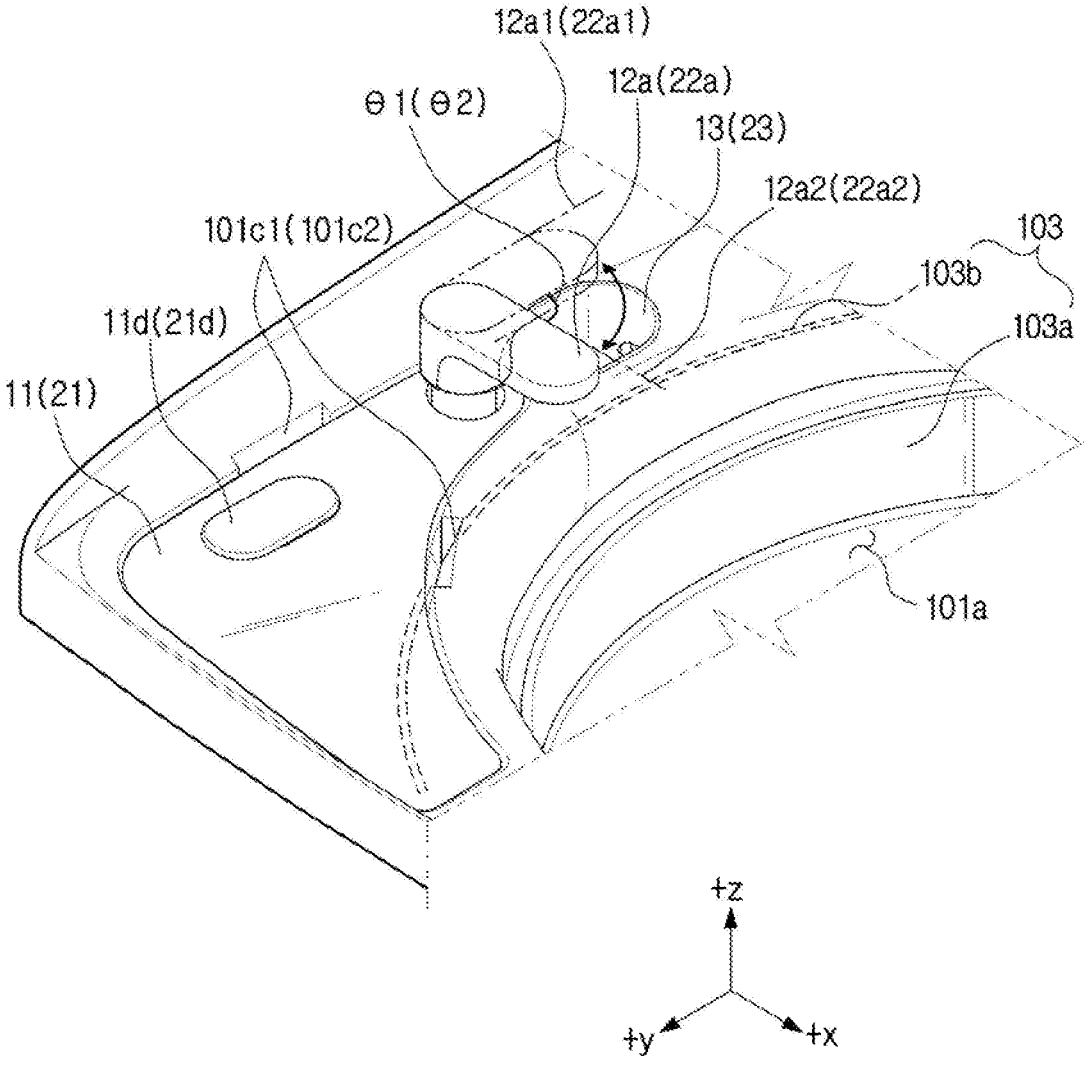
FIGS. 6A and 6B are schematic perspective views illustrating a detergent supply unit manually supplying a detergent according to another embodiment of the present disclosure.
Figure 6B:
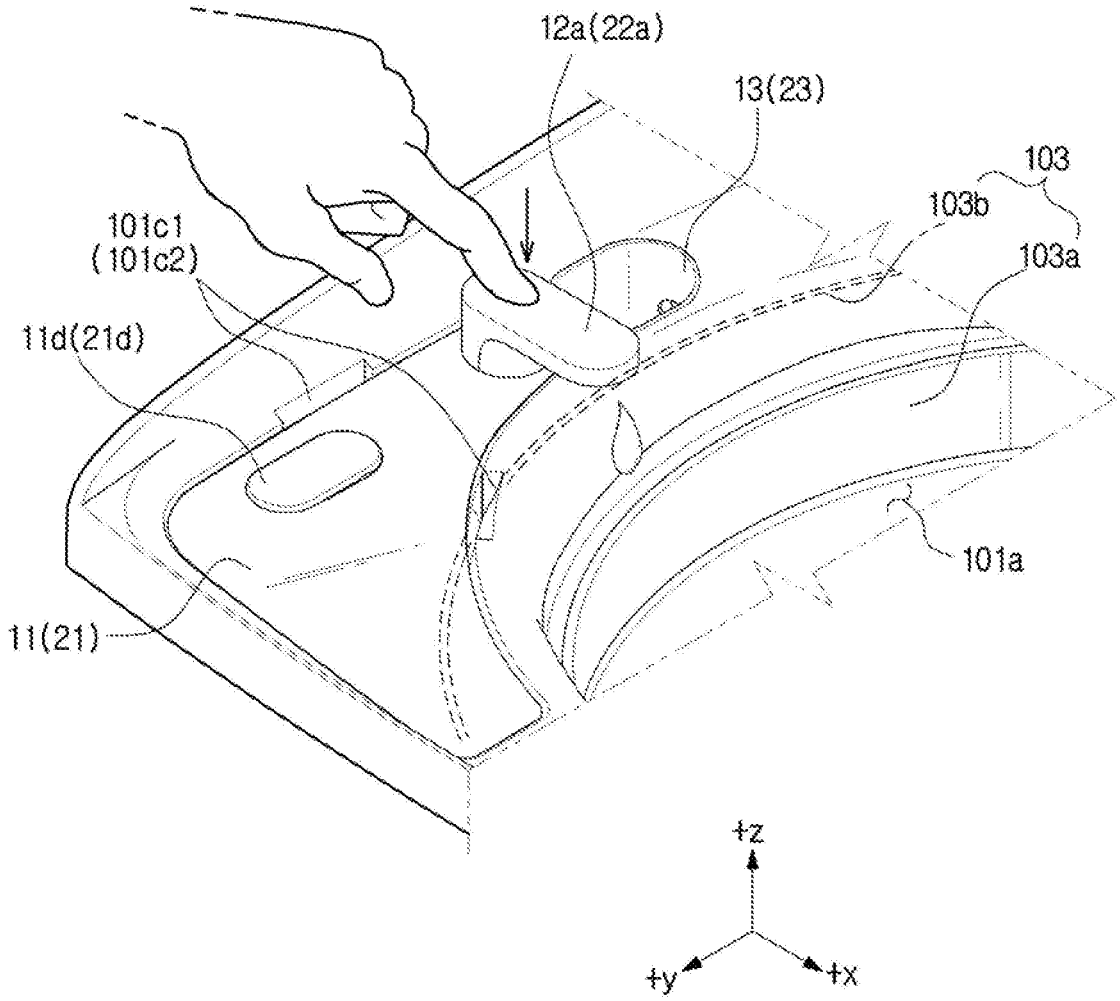

FIGS. 6A and 6B are schematic perspective views illustrating a detergent supply unit manually supplying a detergent according to another embodiment of the present disclosure.

Referring to FIGS. 6A and 6B, according to another embodiment of the present disclosure, a user may manually supply detergents (or softening agents) to a washing tub 103.

In FIGS. 6A and 6B, a door 102 is in an open state. When the door 102 is opened, a user can additionally supply detergents (or softening agents) manually. When the door 102 is opened, it may be difficult to supply detergents (or softening agents) by power pumping in the washing machine 100. The manual supply will be described with reference to the detergent supply unit 10, and it will be substantially similarly (for example, difference between the detergent supply unit and the softening agent supply unit) applied to the softening agent supply unit 20 corresponding to the detergent supply unit 10.

A user can switch (or rotate) the pump handle 12*a* in the first position 12*a*1 to the second position 12*a*2 in the detergent supply unit 10. The second position 12*a*2 of the pump handle 12*a* may be a position capable of manually supplying the detergent directly. For example, with respect to the first position 12*a*1, an angle range θ1 of the second position 12*a*2 may be 30° or more and 110° or less. Alternatively, the angle range θ1 may be 37° or more and 151° or less.

A position of the pump handle 12*a* that is automatically pumped by the driving force of the motor 171 (for example, the first position 12*a*1) may be different from a position of the pump handle 12*a* that is manually pumped by a user (for example, the second position 12*a*2).

When the pump handle 12*a* is in the second position 12*a*2 or when the pump handle 12*a* is positioned within the angle range θ1, a user may apply a pressure (or force) to the pump handle 12*a*. The pump handle 12*a* may be operated by the pressure (for example, (vertical) linear motion). Some 11*e* of the detergent contained in the detergent dispenser 11 may be supplied to the washing tub 103 by the lowering of the pump handle 12*a*. An amount of detergent, which is supplied once by pumping that is directly (or indirectly) performed by a user, may be 40 ml or more and 50 ml or less (for example, an amount of detergent to be supplied once may vary)

A user can switch (or rotate) the pump handle 22*a* in the first position 22*a*1 to the second position 22*a*2 in the softening agent supply unit 20. The second position 22*a*2 of the pump handle 22*a* may be a position capable of manually supplying the softening agent directly. For example, with respect to the first position 22*a*1, an angle range θ2 of the second position 22*a*2 may be 30° or more and 110° or less. Alternatively, the angle range θ2 may be 37° or more and 151° or less.

A position of the pump handle 22*a* that is automatically pumped by the driving force of the motor 181 (for example, the first position 22*a*1) may be different from a position of the pump handle 22*a* that is manually pumped by a user (for example, the second position 22*a*2).

When the pump handle 22*a* is in the second position 22*a*2 or when the pump handle 22*a* is positioned within the angle range θ2, a user may apply a pressure (or force) to the pump handle 22*a*. The pump handle 22*a* may be operated by the pressure (for example, (vertical) linear motion). Some 21*e* of the softening agent contained in the softening agent dispenser 21 may be supplied to the auxiliary door 104 by the lowering of the pump handle 22*a*. An amount of softening agent, which is supplied once by manual pumping may be 40 ml or more and 50 ml or less (for example, an amount of softening agent to be supplied once may vary).

According to another embodiment of the present disclosure, a user may supply the detergent to the detergent mixing tub 13 by pressing (or manual pumping) the pump handle 12*a* in the first position 12*a*1 in the detergent supply unit 10. A user may additionally supply the detergent to the detergent mixing tub 13 by manual pumping in the first position 12*a*1. Further, a user may supply the softening agent to the softening agent mixing tub 23 by pressing (or manual pumping) the pump handle 22*a* in the first position 22*a*1 in the softening agent supply unit 20. A user may additionally supply the softening agent to the softening agent mixing tub 23 by manual pumping in the first position 12*a*1.

Figure 7:
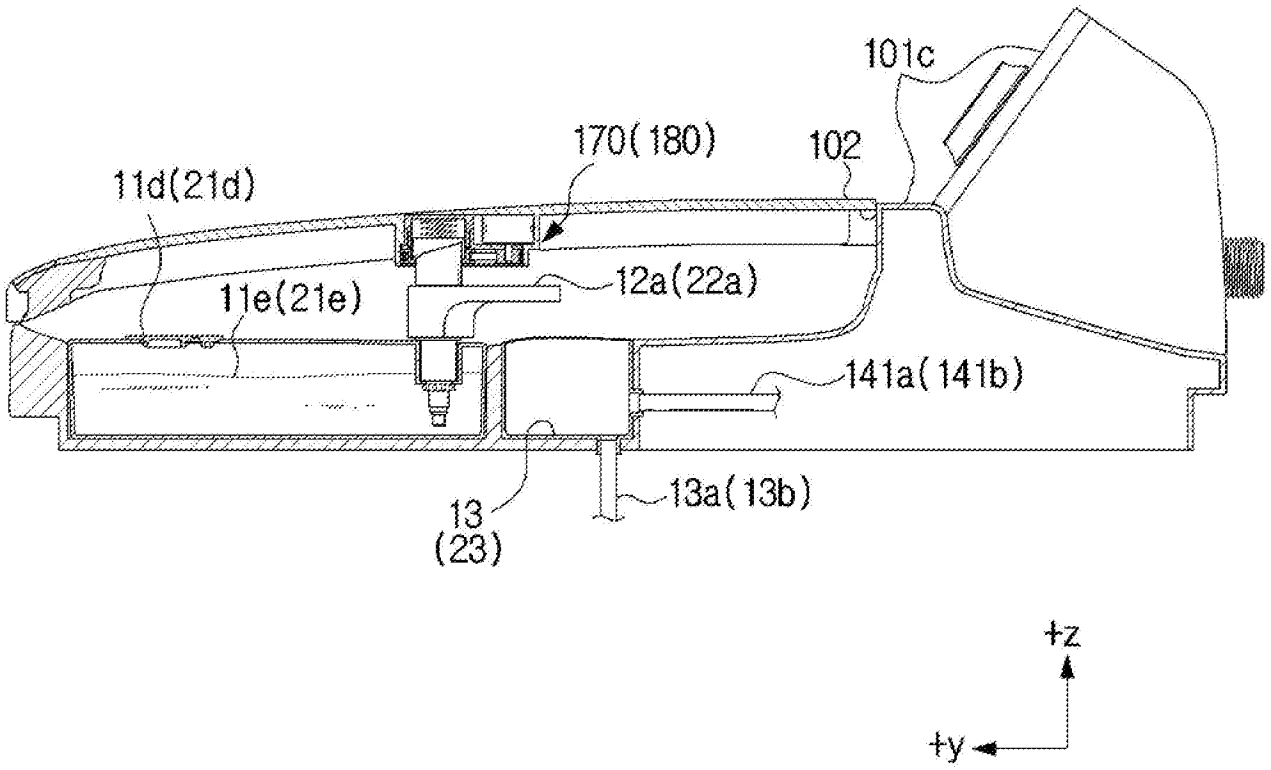
FIG. 7 is a schematic cross-sectional view illustrating a cover and the detergent supply unit of the washing machine according to one embodiment of the present disclosure.

FIG. 7 is a schematic cross-sectional view illustrating a cover and the detergent supply unit of the washing machine according to one embodiment of the present disclosure.

FIG. 7 may illustrate a cross-section taken along a line A-A' of FIG. 2.

When the door 102 is closed, the driver 170 is coupled to the door 102. On the bottom of the door 102, the rotary cam bottom 172*b* may be exposed downward (for example, the −z-axis direction) from the driver 170. The pump 12 of the detergent dispenser 11 may be positioned under the rotary cam bottom 172*b* (for example, the −z axis direction).

The bottom surface of the rotary cam bottom 172*b* may be in contact (or non-contact) with an upper surface of the pump handle 12*a* of the detergent dispenser 11. When the rotary cam bottom 172*b* performs a reciprocating motion by the transmitted driving force, the bottom surface of the rotary cam bottom 172*b* in a non-contact state may come into contact with the upper surface of the pump handle 12*a* of the detergent dispenser 11.

When the door 102 is closed, the driver 180 is coupled to the door 102. On the bottom of the door 102, the rotary cam bottom 182*b* may be exposed downward (for example, the −z-axis direction) from the driver 180. The pump 22 of the softening agent dispenser 21 may be positioned under the rotary cam bottom 182*b* (for example, the −z axis direction).

The bottom surface of the rotary cam bottom 182*b* may be in contact (or non-contact) with an upper surface of the pump handle 22*a* of the softening agent dispenser 21. When the rotary cam bottom 182*b* performs a reciprocating motion by the transmitted driving force, the bottom surface of the rotary cam bottom 182*b* in a non-contact state may come into contact with the upper surface of the pump handle 22*a* of the softening agent dispenser 21.

Figure 8A:
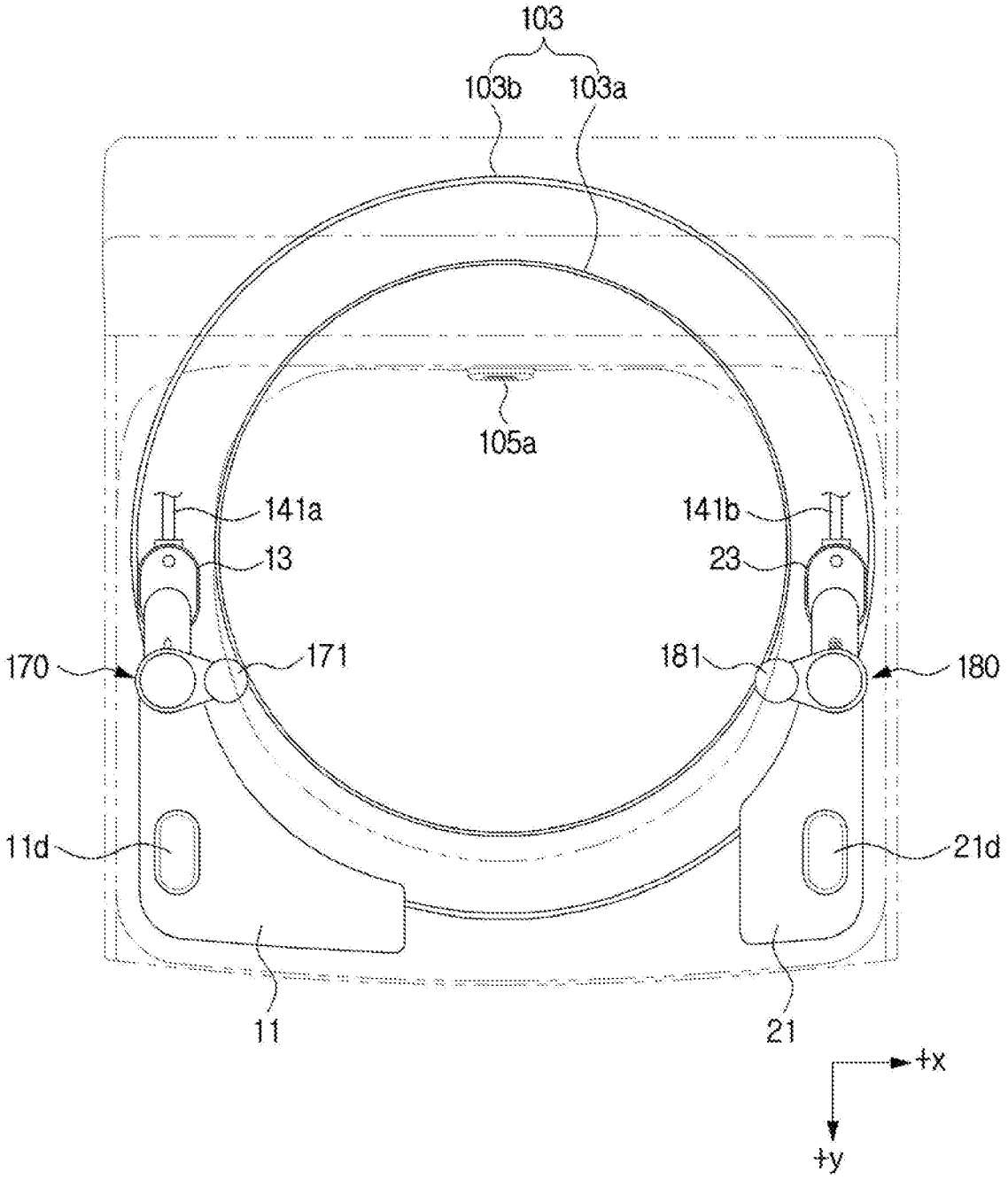
FIG. 8A is a schematic plan view illustrating an arrangement of the detergent supply unit, the softening agent supply unit, and a washing tub according to one embodiment of the present disclosure.
Figure 8B:
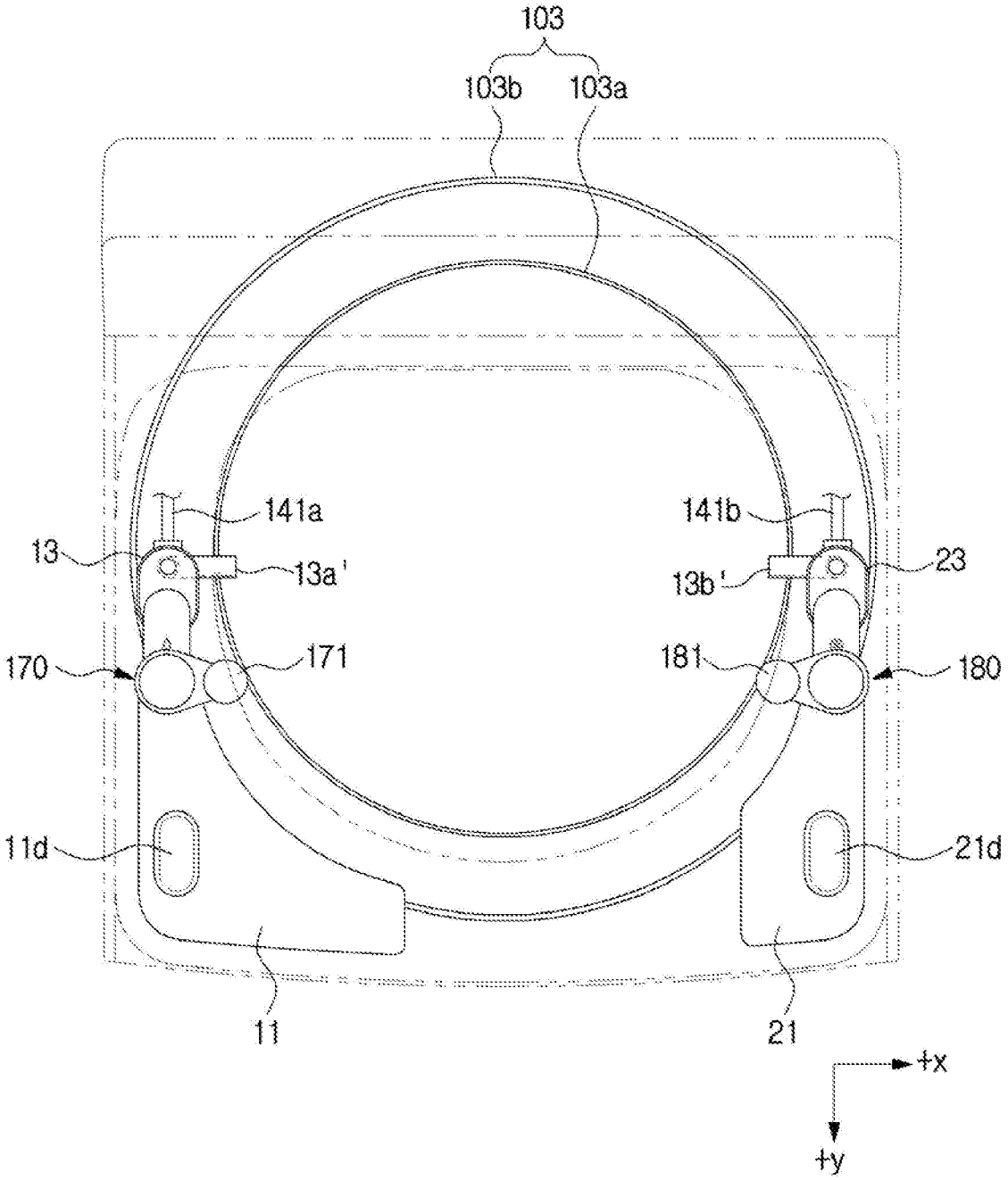
FIG. 8B is a schematic plan view illustrating an arrangement of a detergent supply unit, a softening agent supply unit, and a washing tub according to another embodiment of the present disclosure

FIG. 8A is a schematic plan view illustrating an arrangement of the detergent supply unit, the softening agent supply unit, and the washing tub according to one embodiment of the present disclosure. FIG. 8B is a schematic plan view illustrating an arrangement of the detergent supply unit, the softening agent supply unit, and the washing tub according to another embodiment of the present disclosure.

In FIG. 8A, the detergent supply unit 10, the softening agent supply unit 20, the washing tub 103 and the discharge port 105*a* of the detergent container 105 are illustrated. The detergent supply unit 10 and the softening agent supply unit 20 may be positioned on opposite sides of the upper portion 101*c* of the body 101. The detergent supply unit 10 and the softening agent supply unit 20 positioned above the washing tub 103 may be positioned in the circumferential direction of the washing tub 103. The detergent supply unit 10 and the softening agent supply unit 20 may be positioned on opposite sides with respect to the center of the washing tub 103. The detergent supply unit 10 and the softening agent supply unit 20 may be positioned on opposite sides of the discharge port 105*a*.

The position of the detergent supply unit 10 and the position of the softening agent supply unit 20 may overlap with the washing tub 103. At least one of the position of the detergent supply unit 10 excluding the driver 170 and the position of the softening agent supply unit 20 excluding the driver 180 may not overlap with the rotary tub 103*a*. The capacity of the detergent dispenser 11 in the detergent supply unit 10 may be equal to or different from the capacity of the softening agent dispenser 21 of the softening agent supply unit 20.

A part of the detergent dispenser 11 may be arranged to overlap with the washing tub 103. Further, a part of the softening agent dispenser 21 may be arranged to overlap with the washing tub 103.

In FIG. 8B, the detergent supply unit 10, the softening agent supply unit 20, and the washing tub 103 according to another embodiment of the present disclosure are illustrated. In FIG. 8B, the discharge port 105*a* of the detergent container 105 is excluded which is different from FIG. 8A.

The detergent supply unit 10 and the softening agent supply unit 20 may be positioned on opposite sides of the upper portion 101*c* of the body 101. The detergent supply unit 10 and the softening agent supply unit 20 positioned above the washing tub 103 may be positioned in the circumferential direction of the washing tub 103. The detergent supply unit 10 and the softening agent supply unit 20 may be positioned on opposite sides with respect to the center of the washing tub 103.

The position of the detergent supply unit 10 and the position of the softening agent supply unit 20 may overlap with the washing tub 103. At least one of the position of the detergent supply unit 10 excluding the driver 170 and the position of the softening agent supply unit 20 excluding the driver 180 may not overlap with the rotary tub 103*a*. The mixed water hoses 13*a*' and 13*b*' may protrude in the direction of the central axis of the rotary tub 103*a*. The detergent mixed water may be discharged directly to the rotary tub 130*a* through the mixed water hose 13*a*' protruding in the central axis direction of the rotary tub 103*a*. The softening agent mixed water may be discharged directly to the rotary tub 130*a* through the mixed water hose 13*b*' protruding in the central axis direction of the rotary tub 103*a*.

The capacity of the detergent dispenser 11 in the detergent supply unit 10 may be equal to or different from the capacity of the softening agent dispenser 21 of the softening agent supply unit 20.

A part of the detergent dispenser 11 may be arranged to overlap with the washing tub 103. Further, a part of the softening agent dispenser 21 may be arranged to overlap with the washing tub 103.

While the present disclosure has been particularly described with reference to exemplary embodiments, it should be understood by those of skilled in the art that various changes in form and details may be made without departing from the spirit and scope of the present disclosure.

Therefore, the spirit of the present disclosure should not be limited to the above-described embodiments, and all of the equivalents or equivalents of the claims, as well as the claims of the following claims, belong to the scope of the present disclosure.

The invention claimed is:

1. A detergent supply unit comprising:

a detergent dispenser mounted to an accommodation portion in an upper portion of a body and configured to accommodate detergents;

a detergent mixing tub configured to mix some of the detergent with washing water;

a pump coupled to the detergent dispenser and configured to supply some of the detergent from the detergent dispenser to the detergent mixing tub; and a driver coupled to a door and configured to transmit a driving force driving the pump, wherein the pump comprises a pump handle configured to perform a reciprocating motion by the driving force, wherein a detergent discharge port configured to discharge some of the detergent is provided at one end of the pump handle.

2. The detergent supply unit of claim 1, wherein the pump further comprises a detergent suction pipe of the pump configured to suck some of the detergent from the inside of the detergent dispenser.

3. The detergent supply unit of claim 2, wherein the pump handle is connected to the detergent suction pipe and the pump handle is positioned outside the detergent dispenser.

4. The detergent supply unit of claim 3, wherein the pump handle is rotatable about the detergent dispenser.

5. The detergent supply unit of claim 1, wherein the pump receives the driving force from a motor of the driver positioned above the pump.

6. The detergent supply unit of claim 1, wherein the driver comprises a motor configured to transmit the driving force to a belt;

the belt configured to receive the driving force from a pulley coupled to a drive shaft of the motor; and a rotary cam configured to receive the driving force from the belt, wherein the rotary cam converts the transmitted driving force to a reciprocating motion.

7. The detergent supply unit of claim 6, wherein a bottom surface of a rotary cam bottom of the rotary cam is exposed in a direction of the pump handle.

8. The detergent supply unit of claim 1, wherein the detergent mixing tub receives washing water from a water supply unit.

9. The detergent supply unit of claim 8, wherein detergent mixed water that is mixed in the detergent mixing tub is discharged through a mixed water hose connected to a lower portion of the detergent mixing tub.

10. The detergent supply unit of claim 9, wherein the detergent mixed water discharged through the mixed water hose is discharged to a washing tub via a detergent container.

11. The detergent supply unit of claim 1, further comprising:

a plurality of accommodation portion grooves provided on opposite sides of the accommodation portion, wherein through the plurality of accommodation portion grooves, a plurality of grooves provided on opposite sides of the detergent dispenser is exposed to be gripped.

* * * * *